US011104359B2

(12) United States Patent
Golembiewski et al.

(10) Patent No.: US 11,104,359 B2
(45) Date of Patent: Aug. 31, 2021

(54) RAILROAD CAR TRUCK ARTICULATED SPLIT FRICTION WEDGE ASSEMBLY

(71) Applicant: Standard Car Truck Company, Rosemont, IL (US)

(72) Inventors: Ronald D. Golembiewski, Chicago, IL (US); Andrew J. Morin, Mokena, IL (US)

(73) Assignee: STANDARD CAR TRUCK COMPANY, Rosemont, IL (US)

( * ) Notice: Subject to any disclaimer, the term of this patent is extended or adjusted under 35 U.S.C. 154(b) by 347 days.

(21) Appl. No.: 16/178,869

(22) Filed: Nov. 2, 2018

(65) Prior Publication Data

US 2019/0185031 A1 Jun. 20, 2019

Related U.S. Application Data

(60) Provisional application No. 62/735,469, filed on Sep. 24, 2018, provisional application No. 62/607,629, filed on Dec. 19, 2017.

(51) Int. Cl.
*B61F 5/12* (2006.01)
*B61F 5/06* (2006.01)

(52) U.S. Cl.
CPC ..... *B61F 5/122* (2013.01); *B61F 5/06* (2013.01)

(58) Field of Classification Search
CPC ..... B61F 5/06; B61F 5/08; B61F 5/12; B61F 5/122; B61F 5/125
See application file for complete search history.

(56) References Cited

U.S. PATENT DOCUMENTS

| | | | | |
|---|---|---|---|---|
| 2,053,990 | A | 9/1936 | Goodwin | |
| 2,827,987 | A | 3/1958 | Williams | |
| 3,024,743 | A | 3/1962 | Williams et al. | |
| 4,084,514 | A | 4/1978 | Bullock | |
| 4,167,907 | A * | 9/1979 | Mulcahy | B61F 5/122 105/193 |
| 4,230,047 | A | 10/1980 | Wiebe | |
| 4,244,298 | A | 1/1981 | Hawthorne et al. | |

(Continued)

OTHER PUBLICATIONS

"International Search Report and Written Opinion", Korean Intellectual Property Office, Application No. PCT/US2018/065672 (16 pages) dated Apr. 9, 2019.

(Continued)

*Primary Examiner* — Robert J McCarry, Jr.
(74) *Attorney, Agent, or Firm* — McCoy Russell LLP

(57) ABSTRACT

A railroad car articulated split friction wedge assembly including first and second articulated friction wedges, wherein the first friction wedge includes a first body, a first decoupling insert, a first pivot member pivotally moveable with respect to the first body and the first decoupling insert, and a first wear pad removably attached to the first pivot member, and wherein the second friction wedge includes a second body, a second decoupling insert, a second pivot member pivotally moveable with respect to the second body and the second decoupling insert, and independently of the first body and the first pivot member, and a second wear pad removably attached to the second pivot member, which in combination provide required damping, provide high warp restraint, reduce binding, and enable lateral decoupling.

34 Claims, 29 Drawing Sheets

(56) References Cited

U.S. PATENT DOCUMENTS

| | | | | |
|---|---|---|---|---|
| RE31,988 | E | 9/1985 | Wiebe | |
| 4,915,031 | A | 4/1990 | Wiebe | |
| 5,511,489 | A | 4/1996 | Bullock | |
| 5,555,817 | A | 9/1996 | Taillon et al. | |
| 5,555,818 | A | 9/1996 | Bullock | |
| 5,943,961 | A * | 8/1999 | Rudibaugh | B61F 5/122 105/198.2 |
| 6,269,752 | B1 | 8/2001 | Taillon | |
| 6,374,749 | B1 | 4/2002 | Duncan et al. | |
| 6,659,016 | B2 | 12/2003 | Forbes | |
| 6,688,236 | B2 | 2/2004 | Taillon | |
| 6,691,625 | B2 | 2/2004 | Duncan | |
| 6,701,850 | B2 | 3/2004 | McCabe et al. | |
| 6,874,426 | B2 | 4/2005 | Forbes | |
| 6,895,866 | B2 | 5/2005 | Forbes | |
| 6,971,319 | B2 | 12/2005 | Bowden | |
| 7,143,700 | B2 | 12/2006 | Forbes et al. | |
| 7,328,659 | B2 | 2/2008 | Forbes | |
| 7,389,731 | B2 | 6/2008 | Rudibaugh et al. | |
| 7,497,169 | B2 | 3/2009 | Forbes et al. | |
| 7,549,379 | B2 | 6/2009 | Monaco et al. | |
| 7,699,008 | B2 | 4/2010 | Forbes | |
| 7,845,288 | B2 | 12/2010 | Forbes et al. | |
| 7,946,229 | B2 | 5/2011 | Forbes et al. | |
| 8,869,709 | B2 | 10/2014 | East et al. | |
| 9,446,774 | B2 * | 9/2016 | Wike | B61F 5/122 |

OTHER PUBLICATIONS

Standard Car Truck Company, Barber Friction Wedge Matrix, Dec. 1, 2016, http://www.sctco.com/matrix.html (1 page).

Standard Car Truck Company, Stabilized Components Parts Diagram, Dec. 1, 2016, http://www.sctco.com/products.html (1 page).

* cited by examiner

RAILROAD CAR TRUCK ARTICULATED SPLIT FRICTION WEDGE ASSEMBLY

PRIORITY CLAIM

This application claims priority to and the benefit of U.S. Provisional Patent Application No. 62/607,629, filed Dec. 19, 2017 as well as U.S. Provisional Patent Application No. 62/735,469, filed Sep. 24, 2018, the entire contents of both are incorporated herein by reference.

BACKGROUND

Conventional freight railroad cars in North America and other parts of the world typically include a car body and two spaced apart trucks. The car body or car body under frame typically includes two spaced apart center plates that respectively rest on and are rotatably or swivelly received by bolster bowls of the two trucks. The trucks rollingly support the car body along railroad tracks or rails. Each truck typically has a three piece truck configuration that includes two spaced apart parallel side frames and a bolster. The side frames extend in the same direction as the tracks or rails, and the bolster extends transversely or laterally to the tracks or rails. Each side frame defines a central opening and pedestal jaw openings on each side of the central opening. The bolster extends laterally through and between and is supported by the two spaced apart side frames. Each end of each bolster is typically resiliently supported by a spring group positioned in the central opening of the respective side frame and supported by the lower portion of the side frame that defines the central opening. The spring groups permit the bolster to move with respect to the side frames, primarily along the vertical axes in addition to transverse and longitudinal axes as well. Each truck also typically includes two axles that support the side frames, four wheels, and four roller bearing assemblies respectively mounted on the ends of the axles. The truck further typically includes four bearing adapters respectively positioned on each roller bearing assembly in the respective pedestal jaw opening below the downwardly facing wall of the side frame that defines the top of the pedestal jaw opening. The wheel sets of the truck are received in bearing adapters placed in leading and trailing pedestal jaws in the side frames, so that axles of the wheel sets are generally parallel.

Directions and orientations herein refer to the normal orientation of a railroad car in use. The "leading" side of the truck means the first side of a truck on a railroad car to encounter a turn. The "trailing" side of a truck is opposite the leading side. "Forwardly" or "forward" means in the direction or travel of the truck. "Rearwardly" or "rearward" means in the opposite direction of travel of the truck.

There are continuing need to improve freight car truck performance in the railroad industry. More specifically, while the various current known and commercially available three piece truck configurations meet current Association of American Railroads ("AAR") specifications, enhanced specifications are continually being developed by the AAR; and, it is expected that the current three piece truck configurations may not meet these new AAR specifications. These AAR enhanced specifications set forth or codify the continuing and ongoing demands in the railroad industry for improved freight car truck performance to: (a) reduce wheel wear and damage; (b) reduce rolling resistance; (c) reduce fuel consumption; (d) reduce the need for and thus cost of railroad track repair (including reducing the cost of rail and tie maintenance); (e) improve high speed stability ("HSS") for both empty and loaded freight railroad cars; and (f) improve curving performance for both empty and loaded freight railroad cars.

One area for such improved performance is with friction shoes or wedges. Friction shoes or wedges are typically used in such railroad car trucks to dampen movement of the bolster with respect to each of the side frames of the railroad car truck. The conventional friction shoe or wedge is generally triangular-shaped and includes a body with a generally horizontally extending bottom face, a generally vertically extending face, and an inclined face. This configuration enables the friction shoe to act as a wedge between a downwardly inclined surface of the bolster and a generally vertically extending wear plate attached to an inside column of the side frame (and that partially defines the central opening). The friction shoe is typically wedged in engagement between the bolster and the column of the side frame by one or more of the suspension springs of the respective spring group. Resistance to the sliding movement of the friction shoe with respect to the side frame (that in turn provides damping of bolster movement) is provided by the frictional forces generated between the friction shoe and the wear plate of the side frame column.

Each typical friction shoe provides vertical damping of the suspension and warp stiffness between the respective side frame and the bolster. In certain circumstances, trucks with various known friction shoes tend to provide lower warp restraint. In certain circumstances, various known friction shoes tend to experience a slip-stick type of motion partially due to the high concentrated forces from uneven, or low, friction shoe contact area pushing into the side frame column, specifically at the top or bottom of the friction shoe coupled with high coefficient of friction. Design, manufacturing variations, and/or side frame angulation typically bring about these conditions. In certain circumstances, known friction shoes experience combinations of these problematic conditions. When any of these problematic conditions individually occur or when any combinations of these problematic conditions jointly occur, the overall truck performance decreases or suffers and can result in: (a) impaired vertical damping; (b) potential lading damage; (c) uneven and accelerated localized friction shoe wear; (d) increased wheel wear and damage; (e) increased rolling resistance; (f) increased fuel consumption; (g) increased need for and thus cost for railroad track repair; (h) decreased HSS for both empty and loaded freight railroad cars; and (i) decreased curving performance for both empty and loaded freight railroad cars.

The AAR has developed specific truck tests in an effort to ensure adequate truck performance, specifically in tests requiring the suspension to absorb vertical energy. Instrumented wheels are used during these tests to measure vertical loads into the rail. According to the AAR requirements, any instrumented vertical wheel load must not fall below a minimum value of 10% of the static vertical load and a maximum acceleration of 1G. When these tests are performed on trucks with certain known friction shoes that incur slip-stick or binding conditions with momentary limited motion, the results are often marginal.

Various friction shoes have been proposed and developed to address these issues, but no known friction shoe fully addresses all of these issues. Additionally, proposed changes to AAR M976 may require higher warp restraint trucks to achieve a new loaded car high speed stability requirement while still complying with all other test regimes.

It should also be appreciated that lateral decoupling of the side frame to the bolster is also generally known and desired.

Lateral instability is often due to high speed instability (which is typically referred to as truck hunting). High speed instability or truck hunting is generally due to a kinematic oscillation as the wheel sets (including the tapered wheels rigidly attached to the axles) move along the rail in a sinusoidal pattern. Increasing amplitudes can lead to wheel flange contacts with the rail. When resonance occurs and uncontrolled (wheel set oscillation having the same frequency of the car body natural roll, sway and yaw frequency), the wheel flange contact can generate large lateral forces causing: (a) high lateral impacts; (b) rail damage or wear; (c) wheel wear; (d) other component wear and/or damage; and/or (e) lading damage. It should also be appreciated that lateral track perturbations can laterally displace the wheel set and the truck side frame, and that with a relatively stiff lateral connection between the side frame, the wedge and bolster can transmit such lateral displacements to the car body. The lateral displacement of the tapered wheel set creates a difference in the rolling radius, creating a yaw oscillation leading to lateral instability potentially causing damage to the lading as well as the truck and car components. Therefore, it is desirable to decouple the side frames and bolster to reduce or limit lateral wheel set displacements (oscillations) and thus accelerations into the car body. Loaded and empty car HSS requirements set forth by the AAR limit car body accelerations no greater than 0.13 G standard deviation and 1.5 G peak-to-peak.

Accordingly, there is a general need in the railroad industry for improved truck components (such as friction shoes) that improve overall freight car truck performance. More specifically, there is a need to provide improved friction shoes that provide required damping, that provide high warp restraint, that do not bind or reduce binding improve vertical motion, and that enable lateral decoupling of the side frame from the bolster, decreasing lateral car body accelerations.

SUMMARY

Various embodiments of the present disclosure provide an articulated split friction wedge assembly for a railroad freight car truck. Various embodiments of the present disclosure provide an articulated split friction wedge assembly that: (a) provides required damping; (b) provides high warp restraint; (c) reduces binding improves vertical motion; and (d) enables lateral decoupling, as generally described herein. Various embodiments of the articulated split friction wedge assembly of the present disclosure thus assist in meeting the demands in the railroad industry for improved freight car truck performance to: (a) reduce wheel wear and damage; (b) reduce rolling resistance; (c) reduce fuel consumption; (d) reduce the need for and thus cost of railroad track repair; (e) improve HSS for both empty and loaded freight railroad cars; (f) reduce truck hunting; and (g) improve curving performance for both empty and loaded freight railroad cars.

The articulated split friction wedge assembly of various embodiments of the present disclosure provides these advantages through a combination of features including: (a) an articulating feature that reduces or eliminates high concentrated loading; (b) a composite material feature on the vertically extending faces or surfaces of the friction wedge assembly that provides a near constant coefficient of friction; (c) a split wedge feature that increases warp restraint; (d) a low friction material feature on the articulating member that enables the inclined or sloped portions of the friction wedge assembly to move with the bolster, thus decoupling lateral accelerations into the car truck body; and (e) an optimum wedge assembly angle feature that produces the required force against the side frame column for dampening purposes.

In one example embodiment of the present disclosure, each articulated split friction wedge assembly generally includes two half articulated split friction wedges. Each half articulated split friction wedge generally includes: (a) a sloped body; (b) a decoupling insert; (c) a pivot member pivotally moveable with respect to the sloped body and the decoupling insert; and (d) a composite wear pad removably attached to the pivot member. Thus, the entire articulated split friction wedge assembly includes: (a) a first sloped body; (b) a first decoupling insert; (c) a first pivot member pivotally moveable with respect to the first sloped body and the first decoupling insert; (d) a first composite wear pad removably attached to the first pivot member; (e) a second sloped body; (f) a second decoupling insert; (g) a second pivot member pivotally moveable with respect to the second sloped body and the second decoupling insert; and (h) a second composite wear pad removably attached to the second pivot member.

The articulated split friction wedge assembly is configured to be positioned in a railroad car truck such that: (a) the first and second sloped bodies rest on and are supported by one or more of the suspension springs or spring groups; (b) the first and second sloped bodies engage the respective downwardly inclined wall of the bolster (or a suitable insert there between); and (c) the first and second wear pads independently engage the respective wear plate attached to the respective column of the respective side frame. This enables each articulated split friction wedge assembly to perform its various functions (as further described below) and to provide required damping, provide high warp restraint, reduce binding, and enable lateral decoupling. This configuration also enables the two individual articulated split friction wedges of the articulated split friction wedge assembly to co-act to: (a) reduce wheel wear and damage; (b) reduce rolling resistance; (c) reduce fuel consumption; (d) reduce the need for and thus cost of railroad track repair; (e) improve HSS for both empty and loaded freight railroad cars; (f) reduce truck hunting; and (g) improve curving performance for both empty and loaded freight railroad cars.

Other objects, features, and advantages of the present disclosure will be apparent from the following detailed disclosure, taken in conjunction with the accompanying sheets of drawings, wherein like reference numerals refer to like parts.

Figure 4:
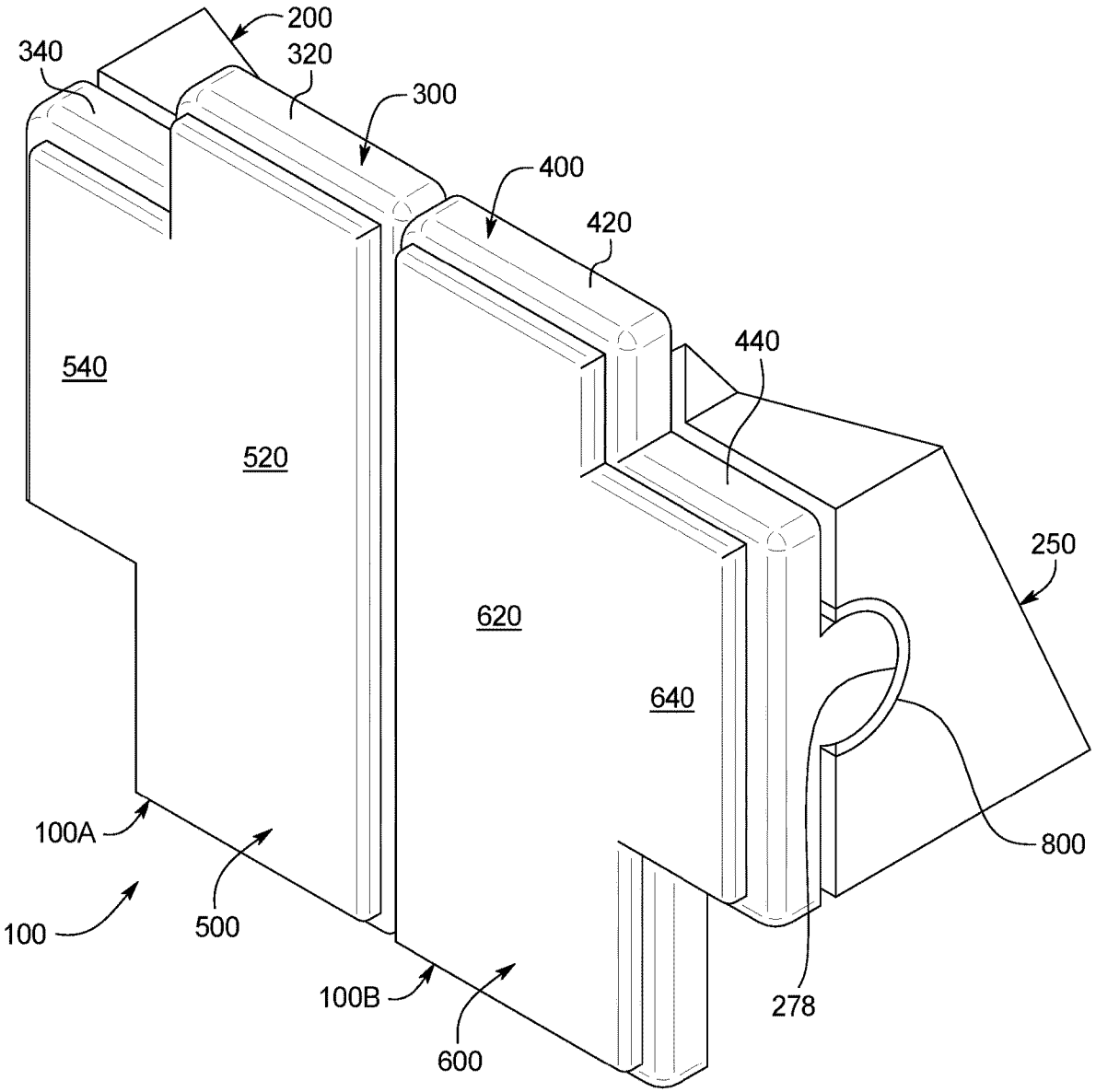
FIG. 4 is a further enlarged front perspective view of one of the articulated split friction wedge assemblies of FIG. 2 and illustrating the two articulated split friction wedges of that articulated split friction wedge assembly.
Figure 5:
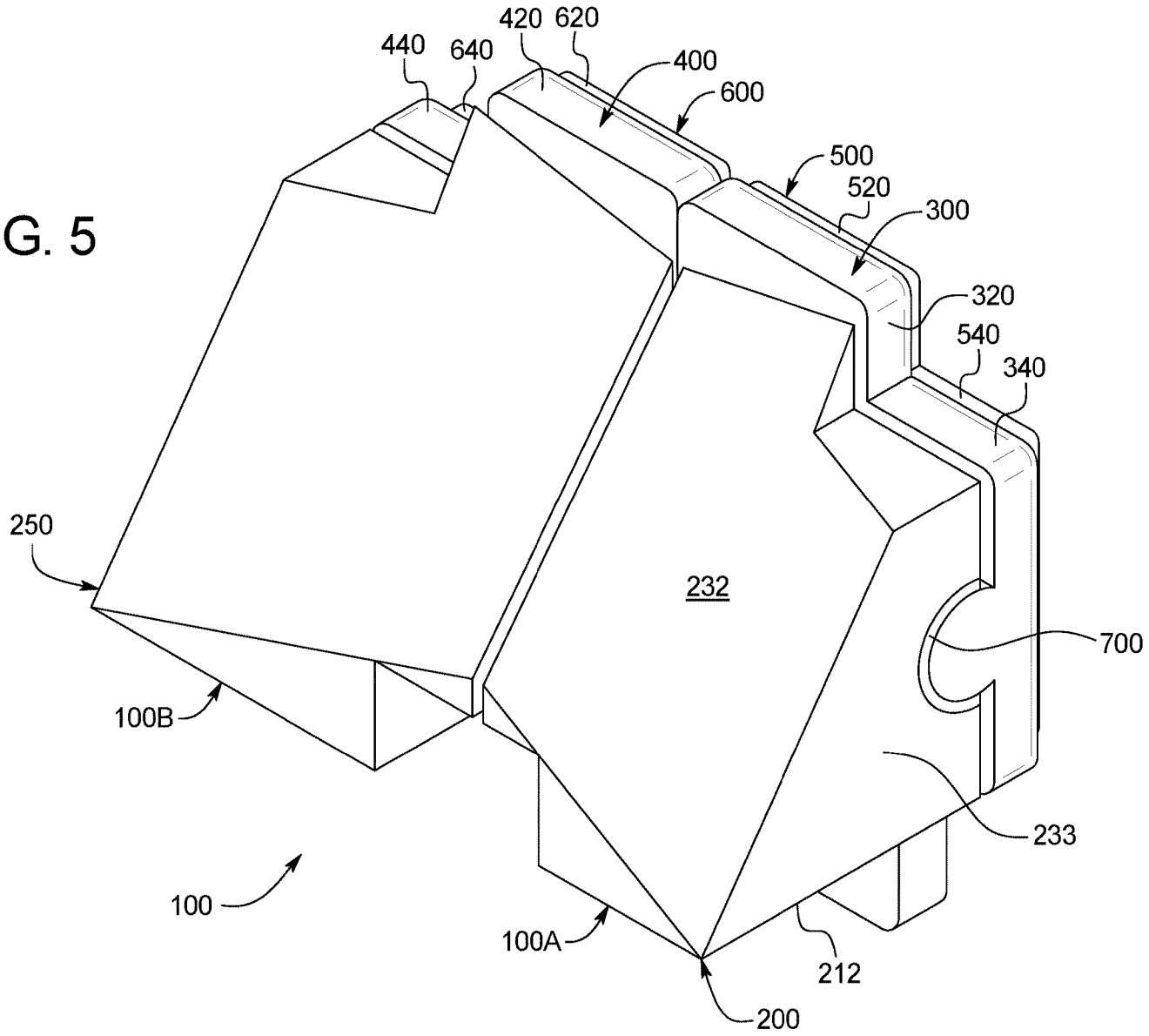

FIG. 5 is an enlarged rear perspective view of the two articulated split friction wedges of FIG. 4.

Figure 6:
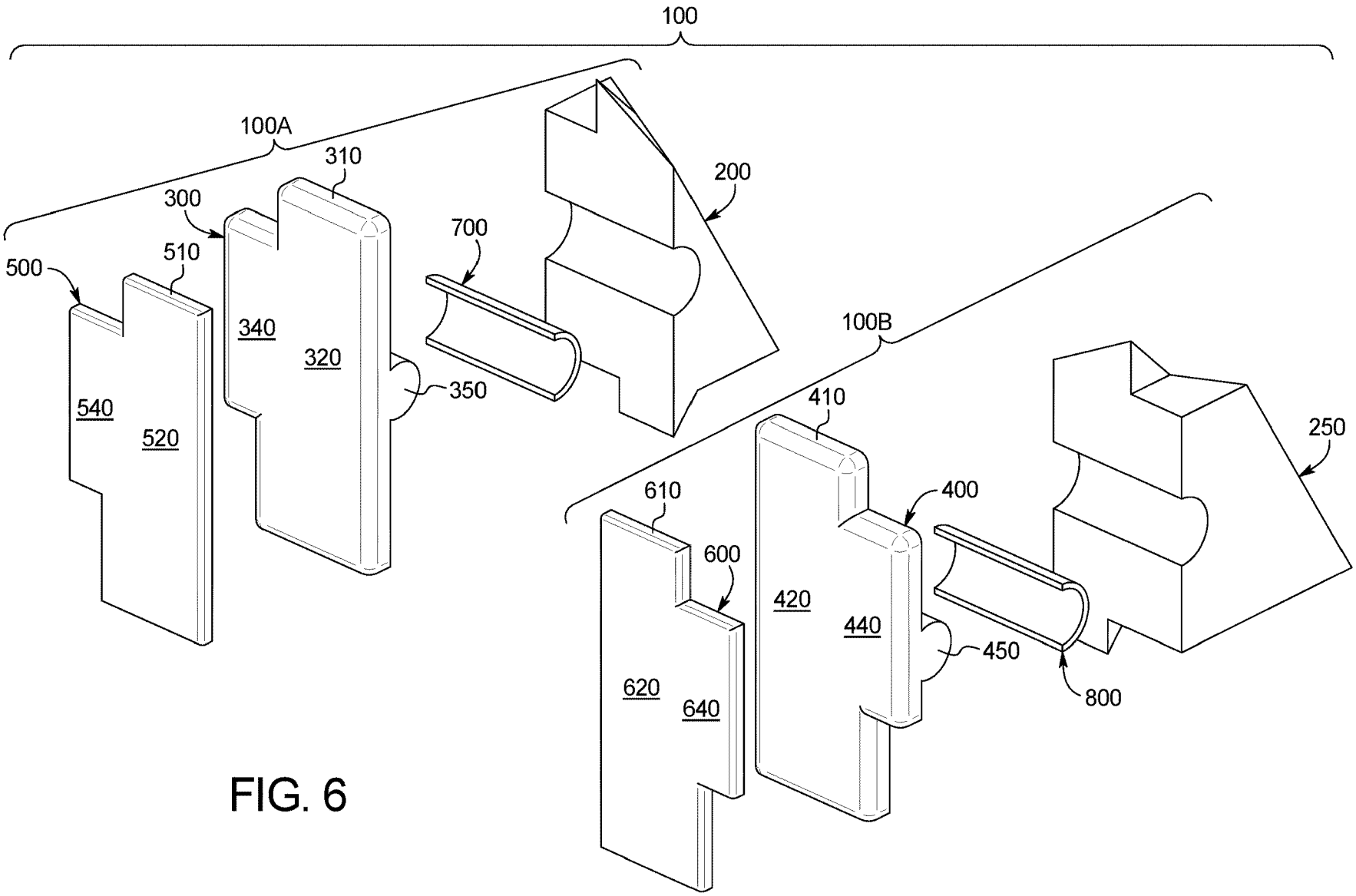

FIG. 6 is an enlarged front exploded perspective view of the two articulated split friction wedges of FIG. 4.

Figure 7:
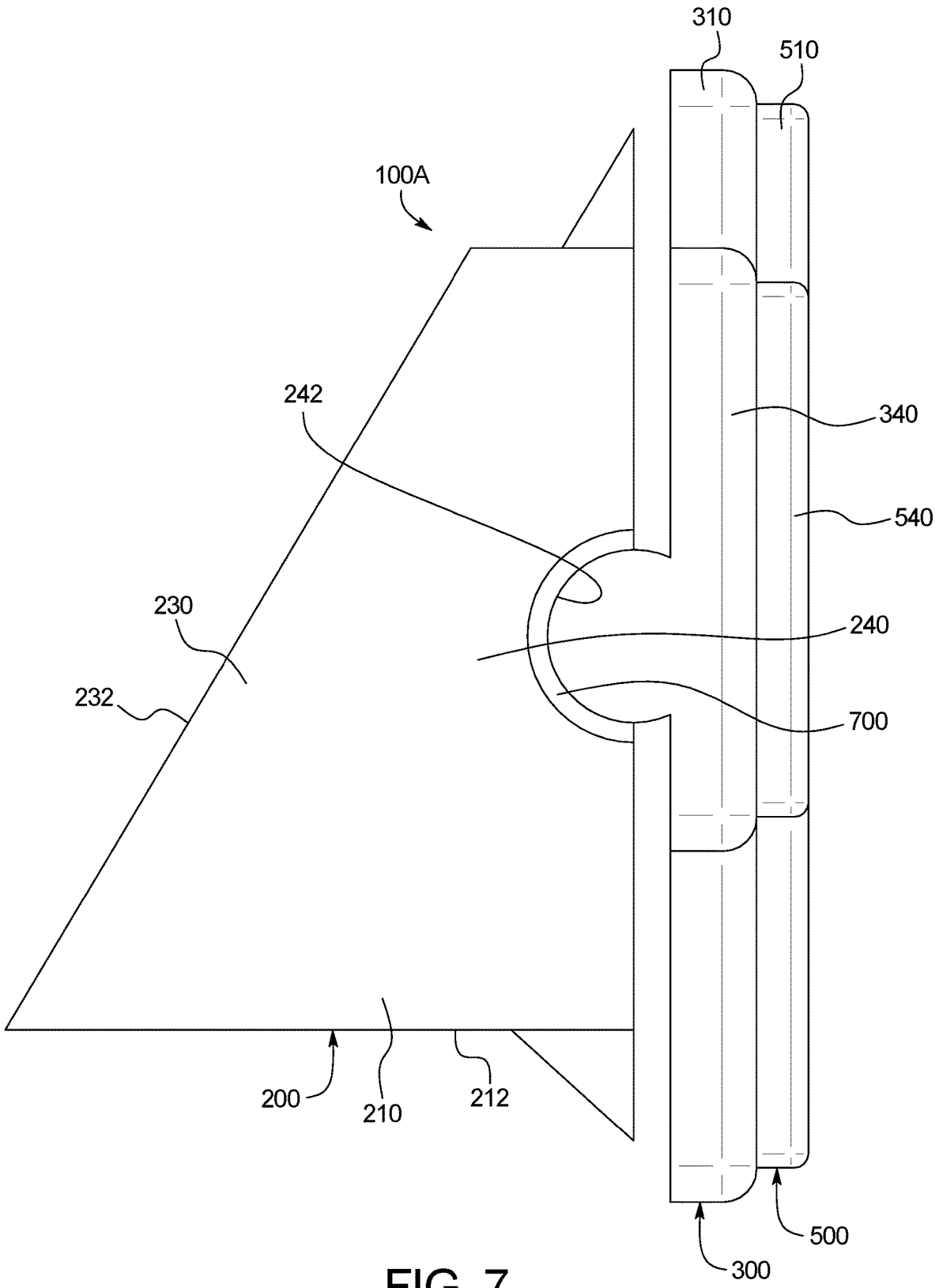

FIG. 7 is an enlarged side view of one of the articulated split friction wedges of FIG. 4.

Figure 8:
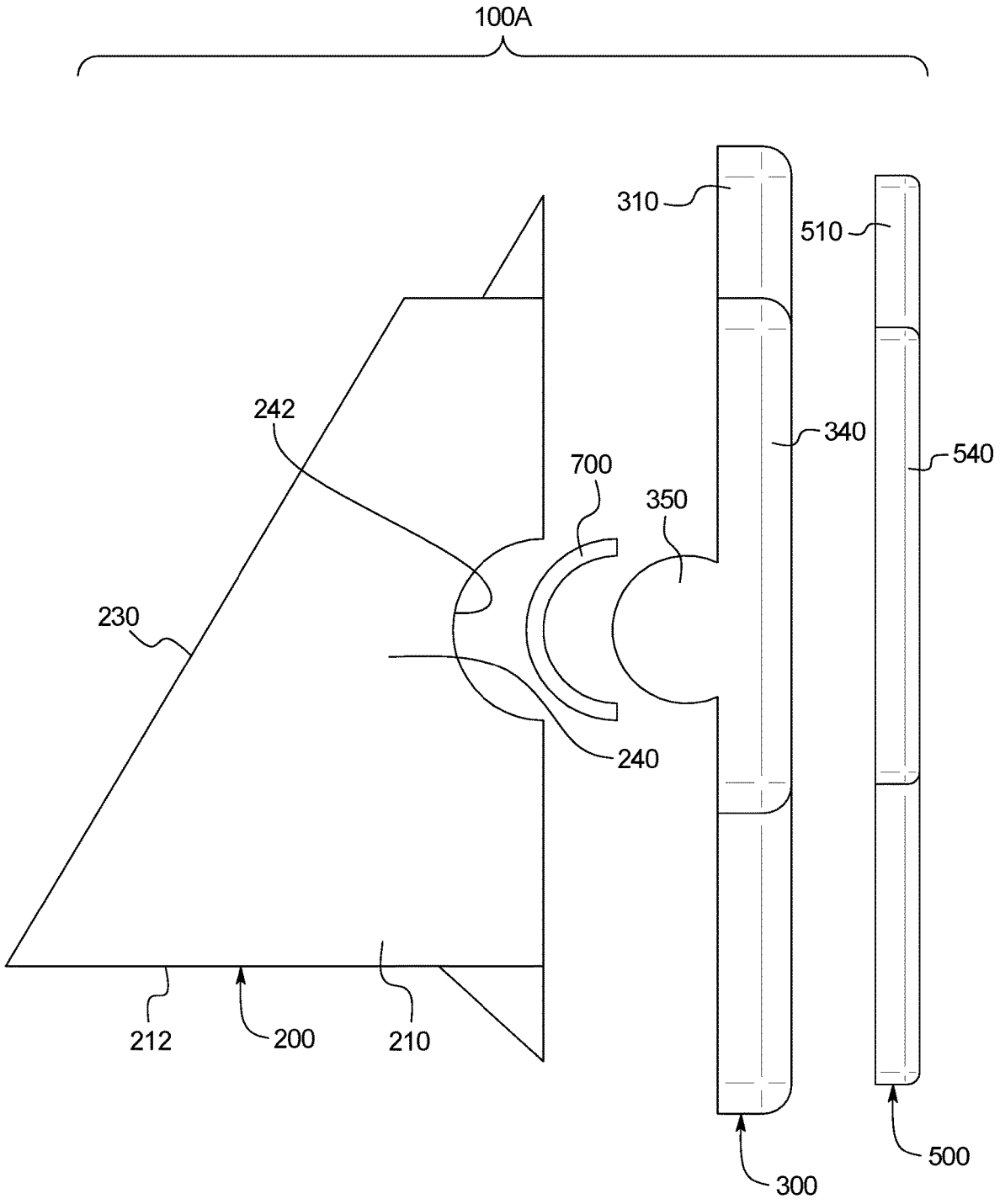

FIG. 8 is an enlarged side exploded view of one of the articulated split friction wedges of FIG. 4.

Figure 9:
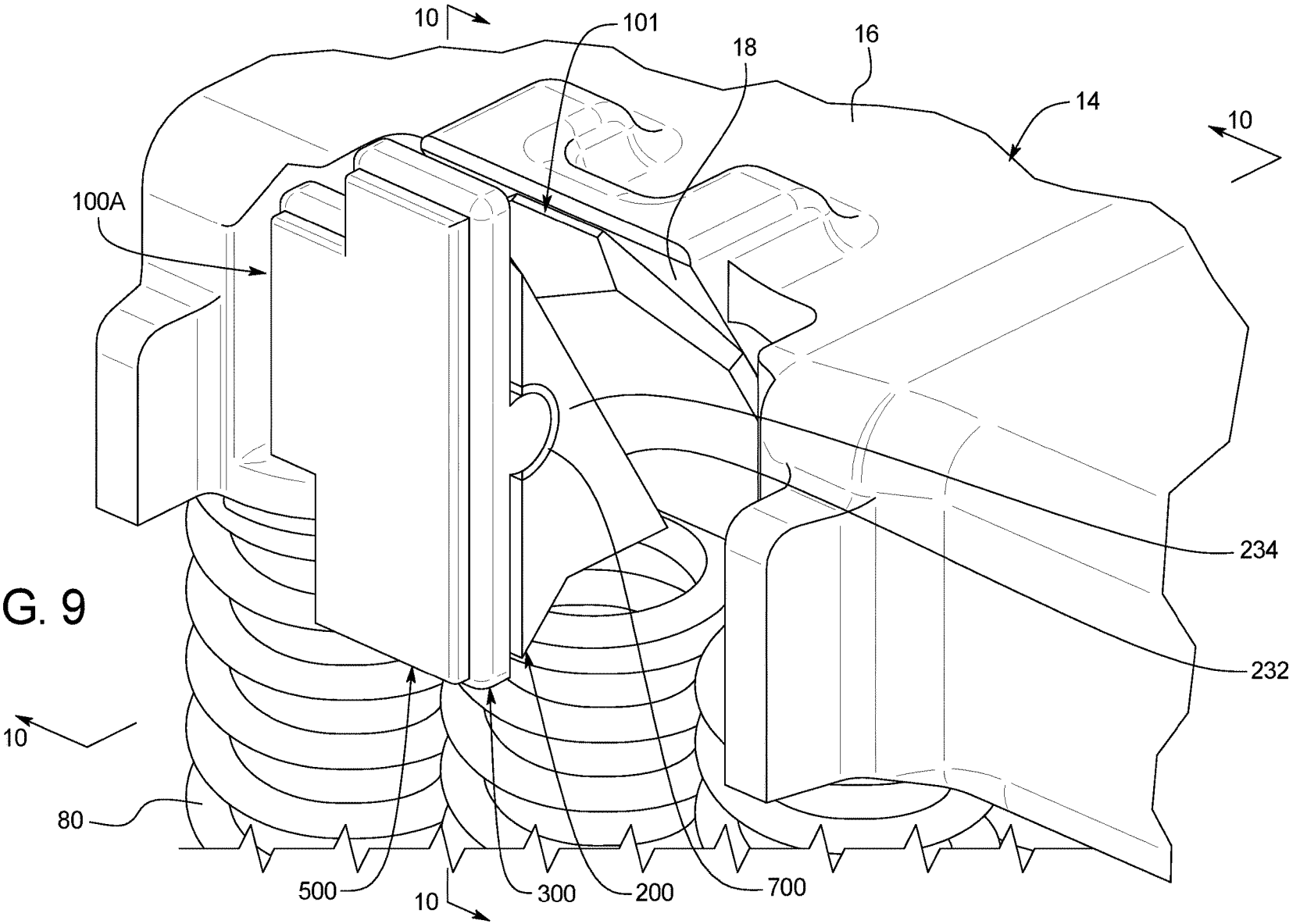

FIG. 9 is an enlarged partial perspective view of one of the articulated split friction wedges of the articulated split friction wedge assembly of FIG. 4 illustrated in position relative to the bolster (shown in fragmentary) and one of the springs (shown in fragmentary) of the railroad car truck.

Figure 10:
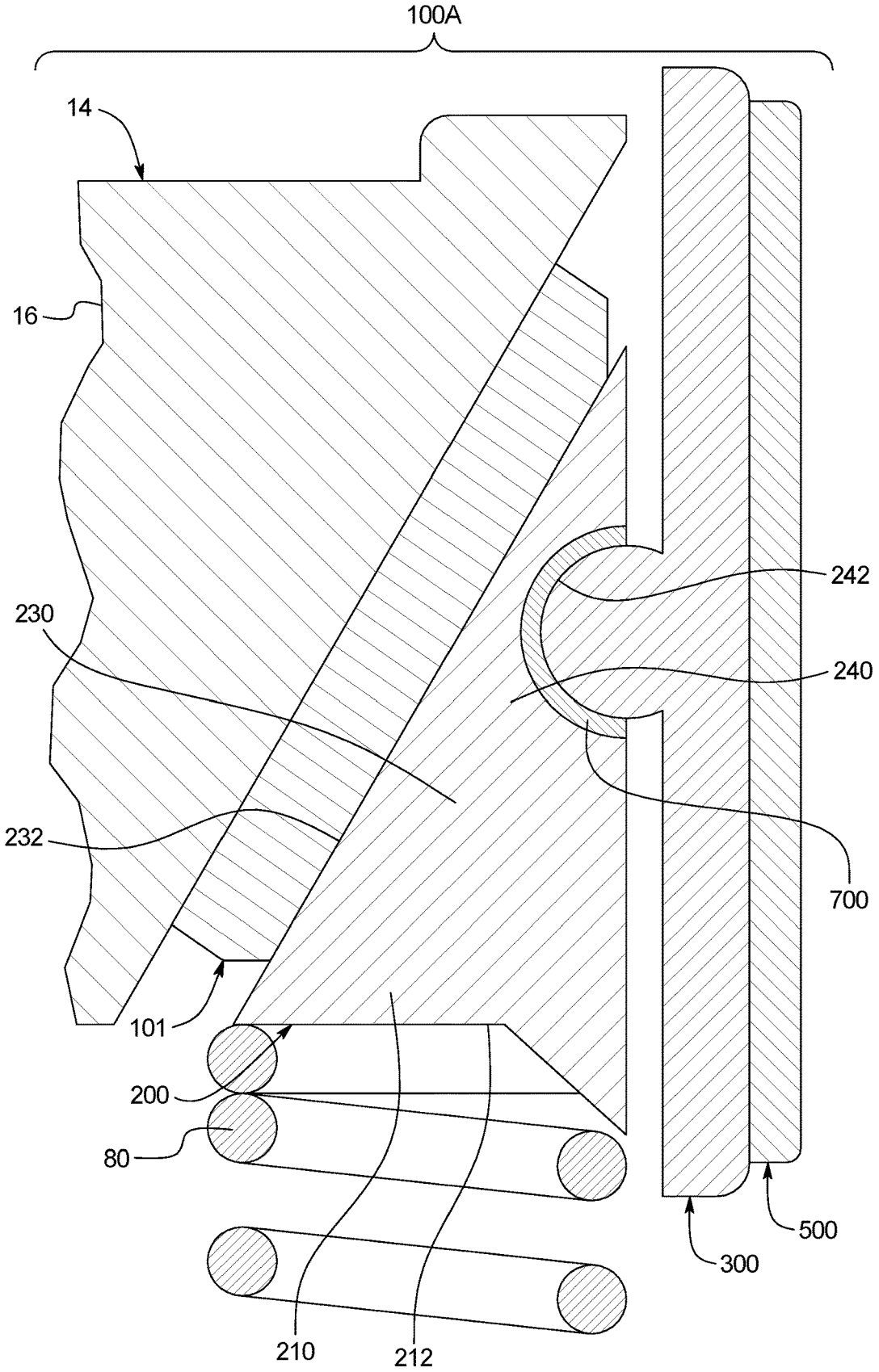

FIG. 10 is an enlarged cross-sectional view of one of the articulated split friction wedges of the articulated split friction wedge assembly of FIG. 4 taken substantially along line 10-10 of FIG. 9 and illustrated in position relative to the bolster (shown in fragmentary) and one of the springs (shown in fragmentary) of the railroad car truck.

Figure 11A:
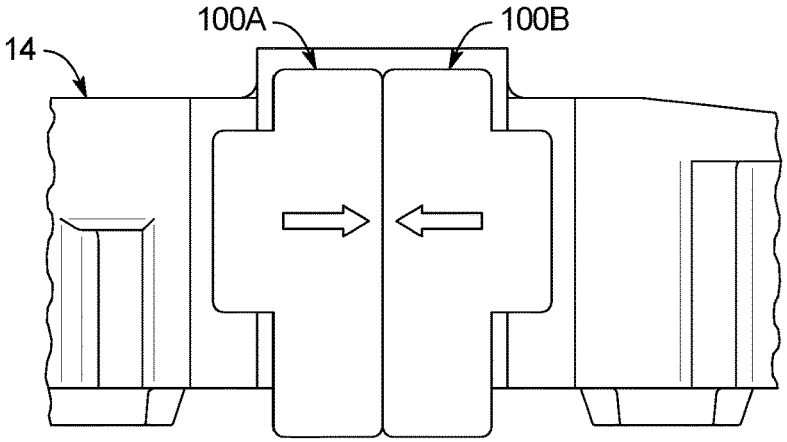

FIG. 11A is a diagrammatic view of the articulated split friction wedge assembly of FIG. 4 illustrated in installation position in the pocket defined by the bolster (shown in fragmentary).

Figure 11B:
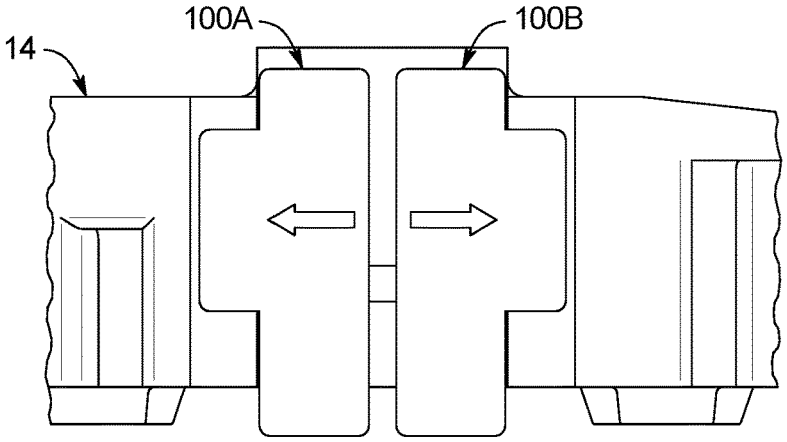

FIG. 11B is a diagrammatic view of the articulated split friction wedge assembly of FIG. 4 illustrated in a first operational position in the pocket defined by the bolster (shown in fragmentary).

Figure 11C:
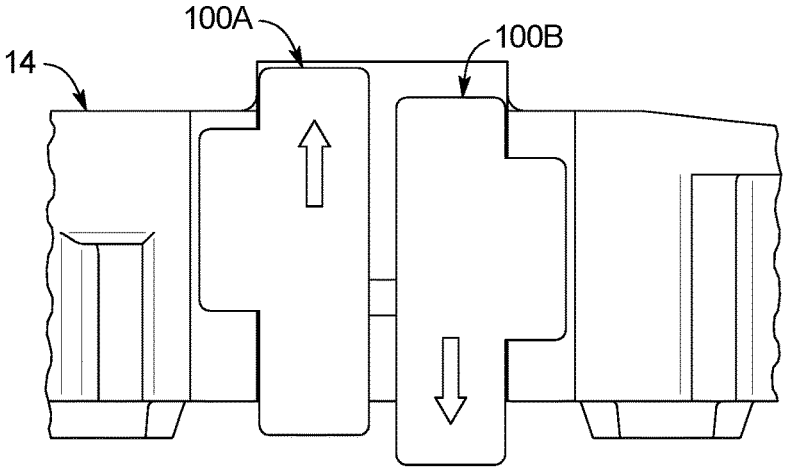

FIG. 11C is a diagrammatic view of the articulated split friction wedge assembly of FIG. 4 illustrated in a second operational position in the pocket defined by the bolster (shown in fragmentary).

Figure 12:
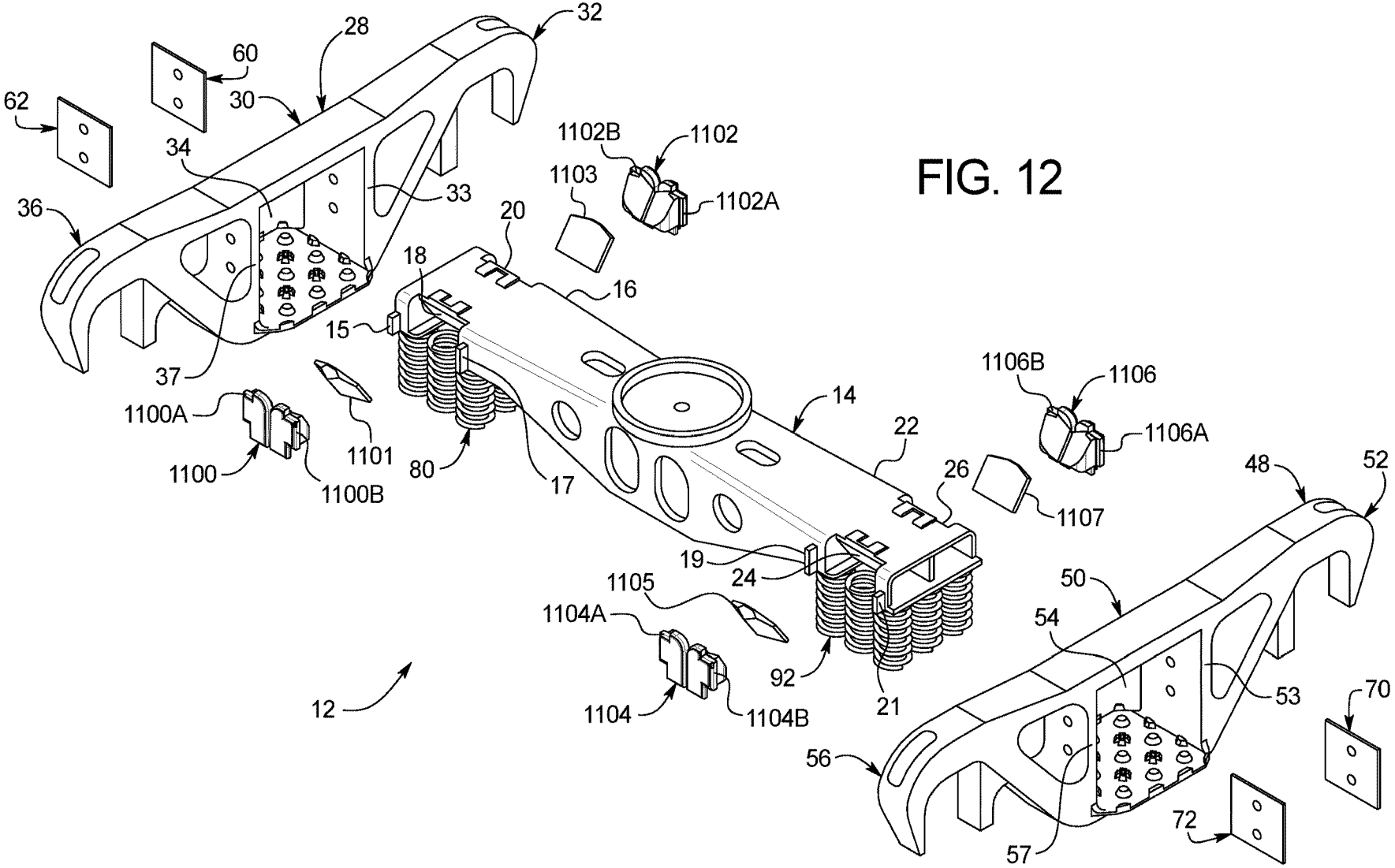

FIG. 12 is an exploded perspective view of certain components of a railroad car truck of another example embodiment of the present disclosure, and illustrating the articulated split friction wedge assembly of another example embodiment of the present disclosure (shown in each of four separate respective locations relative to the bolster and side frames of the railroad car truck).

Figure 13:
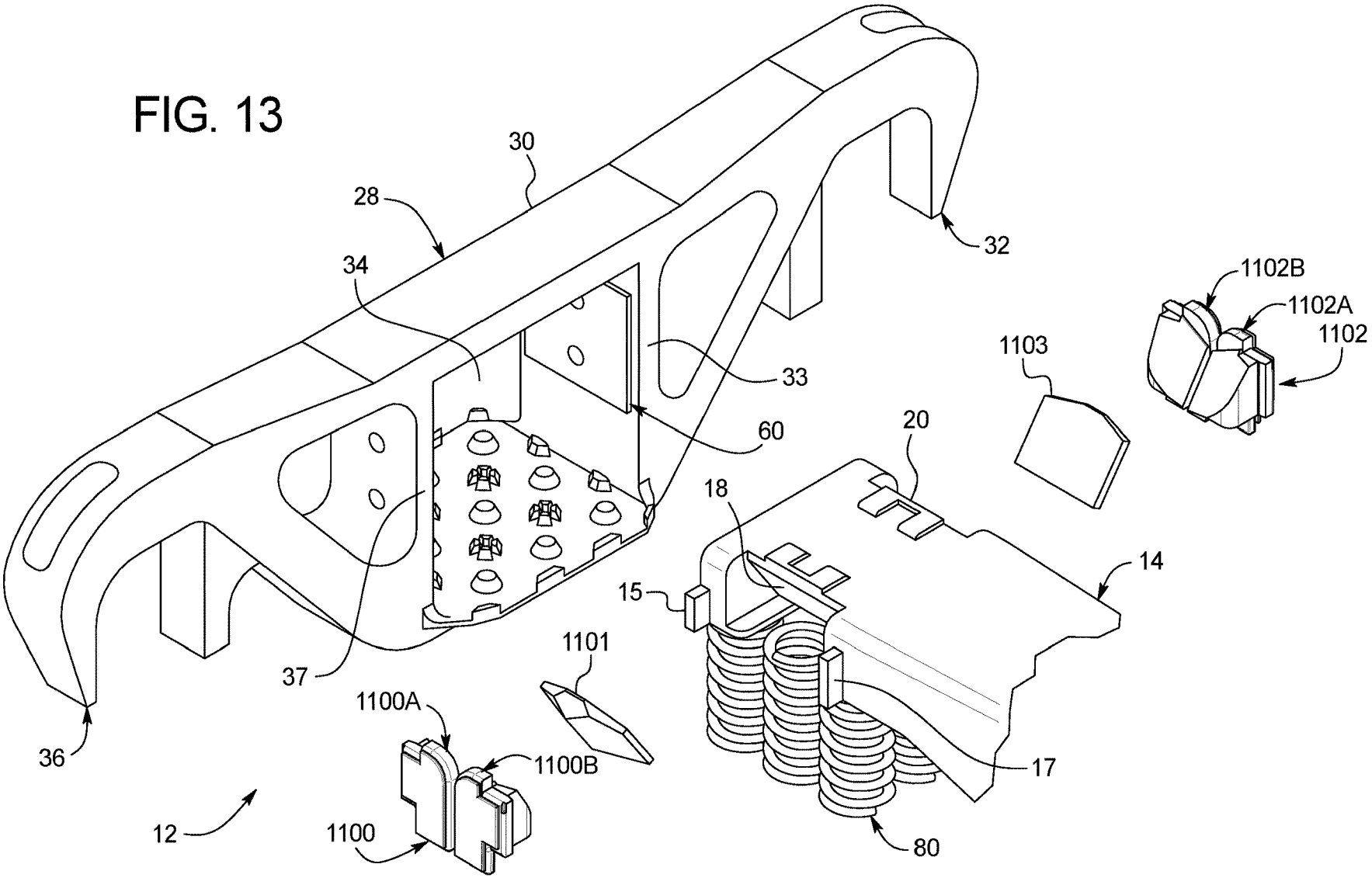

FIG. 13 is an enlarged exploded perspective view of certain components of the railroad car truck of FIG. 12, and illustrating the articulated split friction wedge assembly of FIG. 12 (shown in each of two separate respective locations relative to the bolster (shown in fragmentary) and one of the side frames of the railroad car truck).

Figure 14:
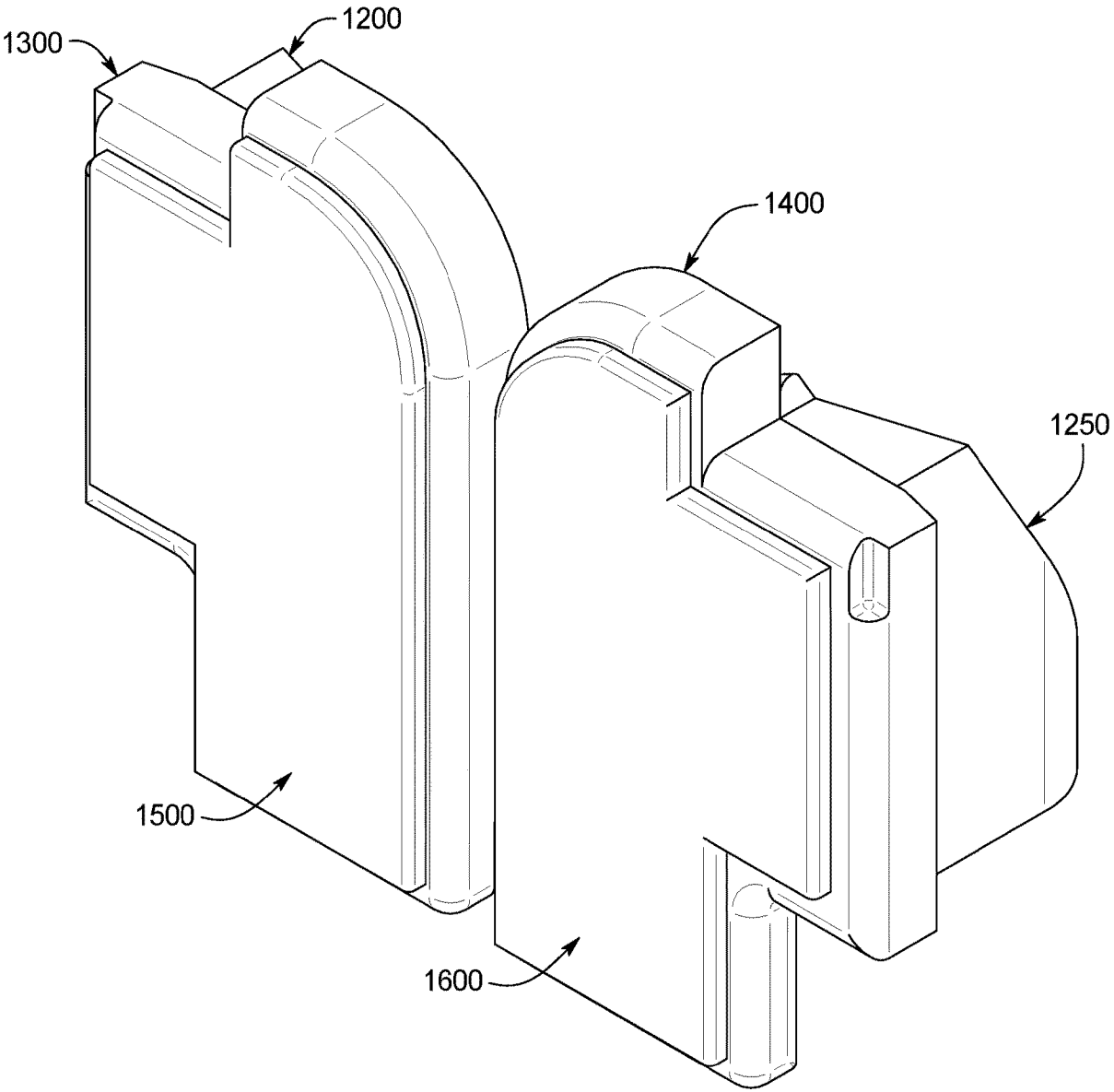

FIG. 14 is a further enlarged front perspective view of one of the articulated split friction wedge assemblies of FIG. 12, and illustrating the two articulated split friction wedges of that articulated split friction wedge assembly.

Figure 15:
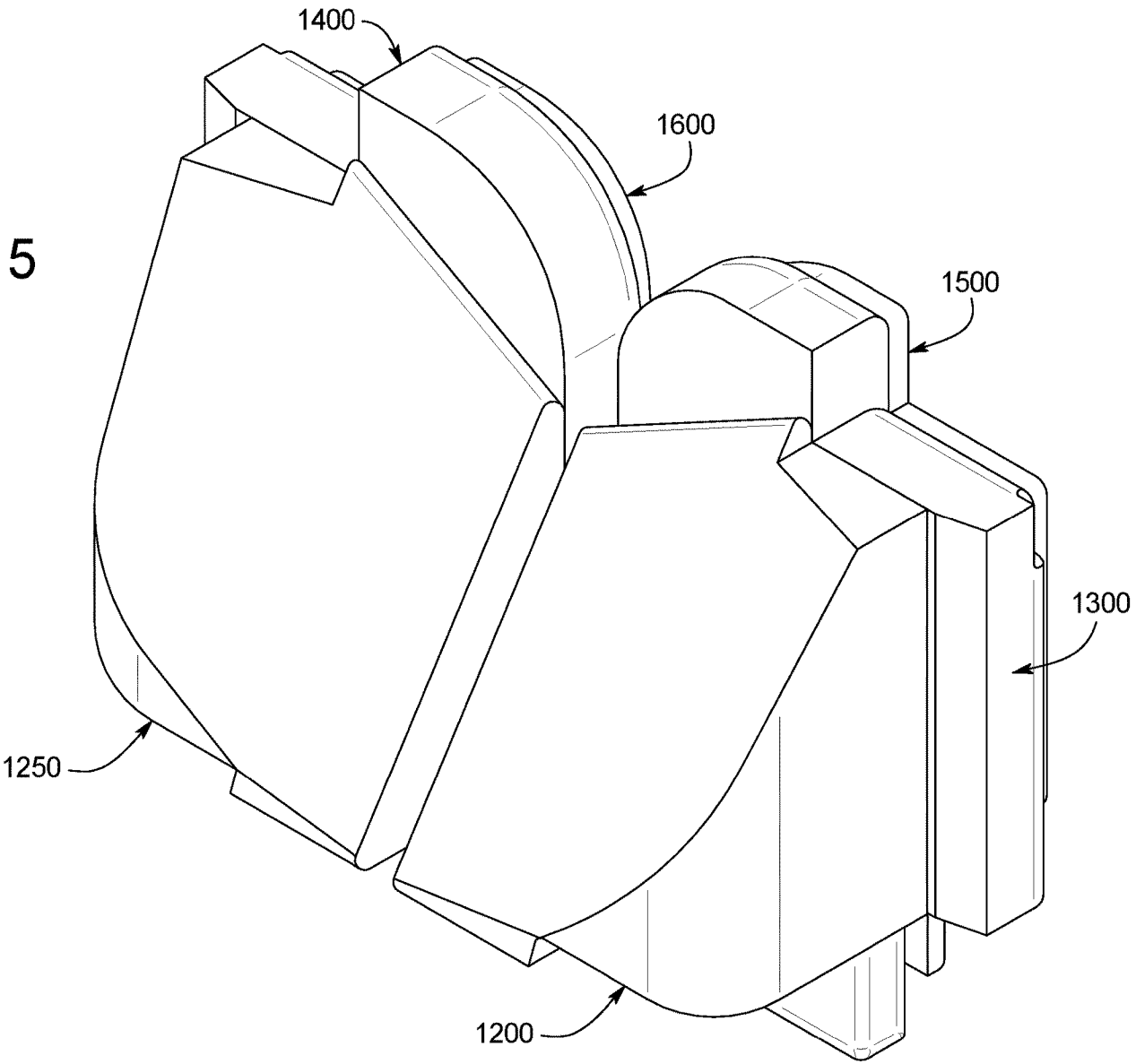

FIG. 15 is an enlarged rear perspective view of the two articulated split friction wedges of FIG. 14.

Figure 16:
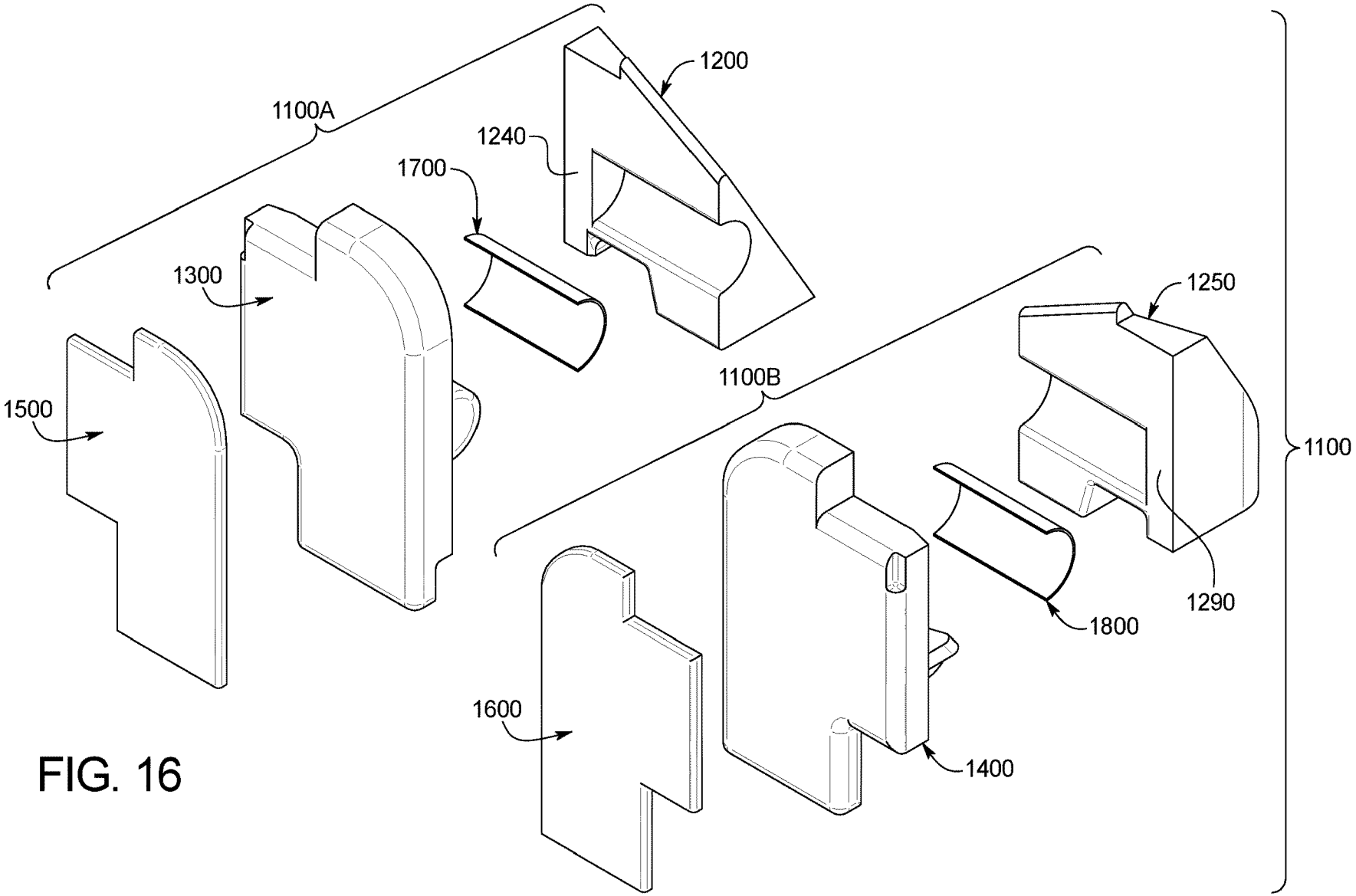

FIG. 16 is an enlarged front exploded perspective view of the two articulated split friction wedges of FIG. 14.

Figure 17:
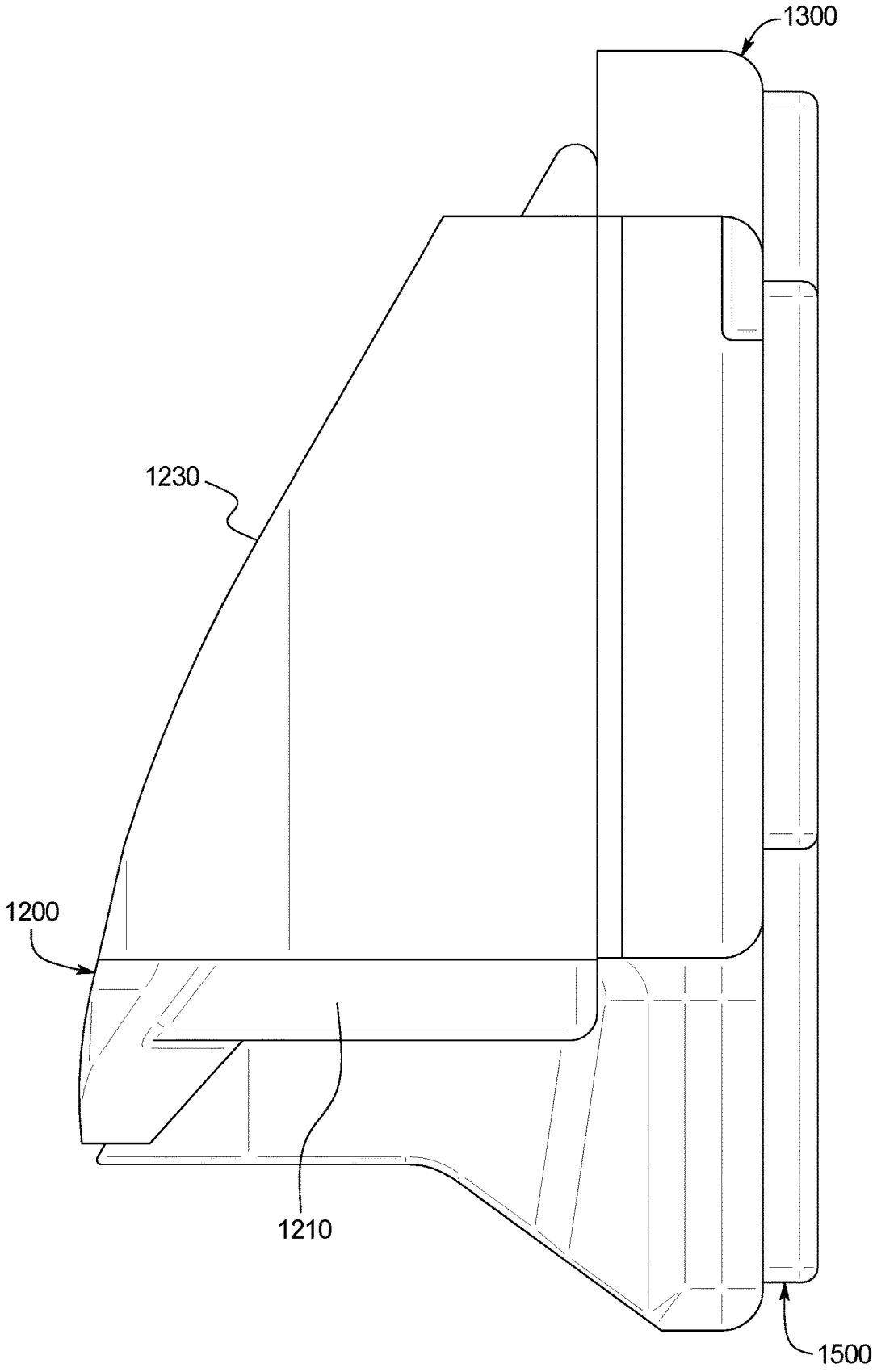

FIG. 17 is an enlarged side view of one of the articulated split friction wedges of FIG. 14.

Figure 18:
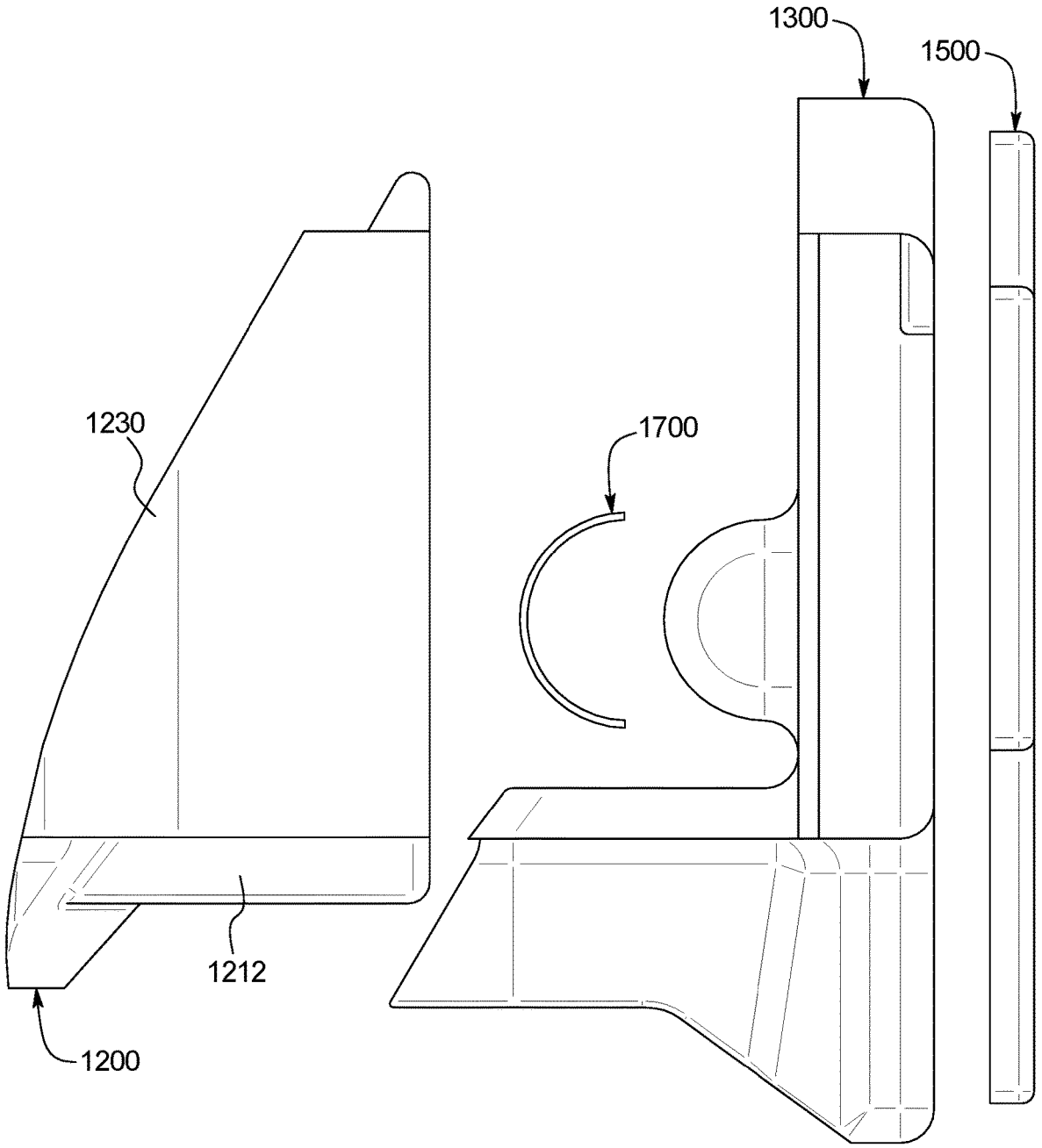

FIG. 18 is an enlarged side exploded view of one of the articulated split friction wedges of FIG. 14.

Figure 19:
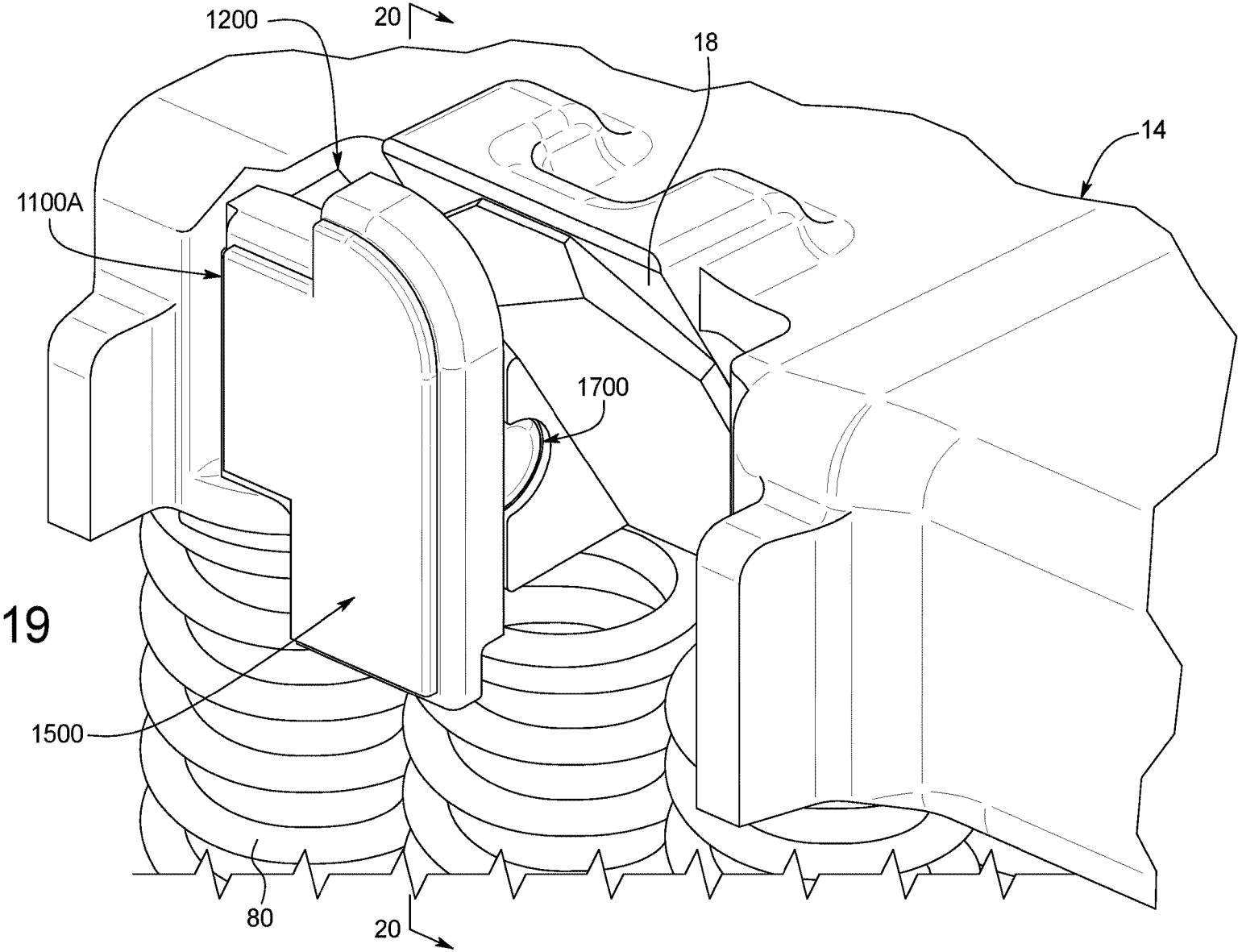

FIG. 19 is an enlarged partial perspective view of one of the articulated split friction wedges of the articulated split friction wedge assembly of FIG. 14 illustrated in position relative to the bolster (shown in fragmentary) and one of the springs (shown in fragmentary) of the railroad car truck.

Figure 20:
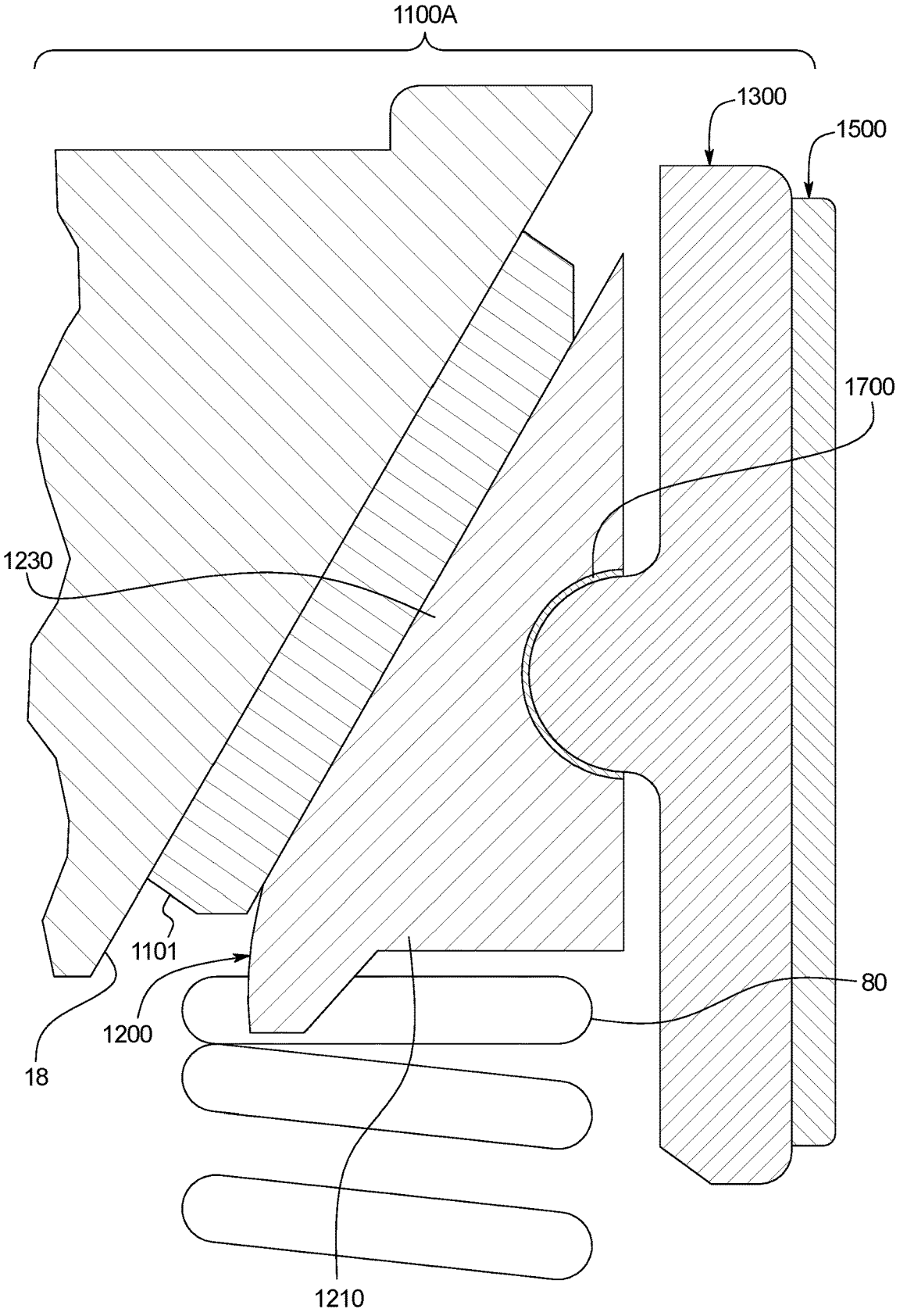

FIG. 20 is an enlarged cross-sectional view of one of the articulated split friction wedges of the articulated split friction wedge assembly of FIG. 14 taken substantially along line 20-20 of FIG. 19 and illustrated in position relative to the bolster (shown in fragmentary) and one of the springs (shown in fragmentary) of the railroad car truck.

Figure 21:
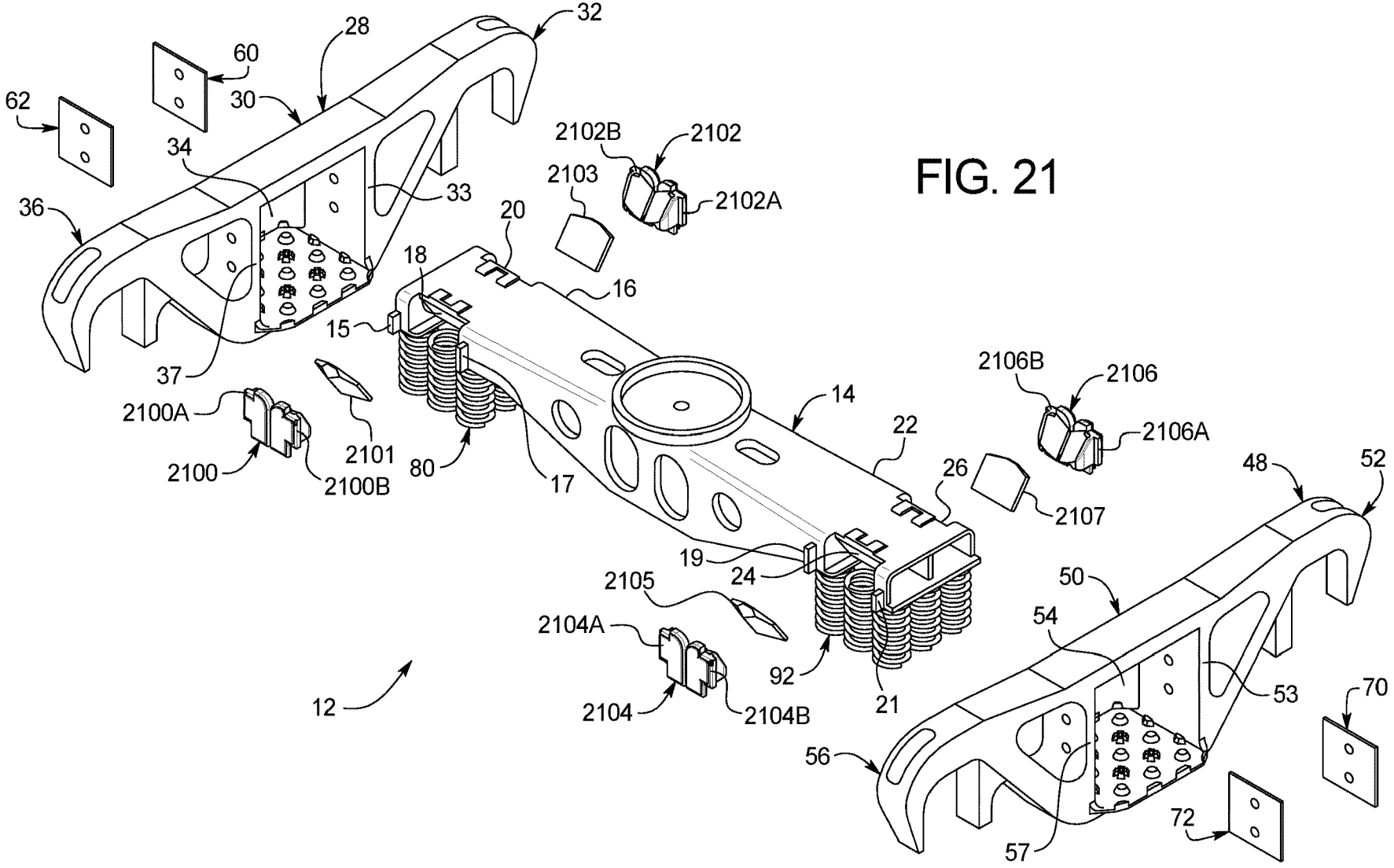

FIG. 21 is an exploded perspective view of certain components of a railroad car truck of another example embodiment of the present disclosure, and illustrating the articulated split friction wedge assembly of another example embodiment of the present disclosure (shown in each of four separate respective locations relative to the bolster and side frames of the railroad car truck).

Figure 22:
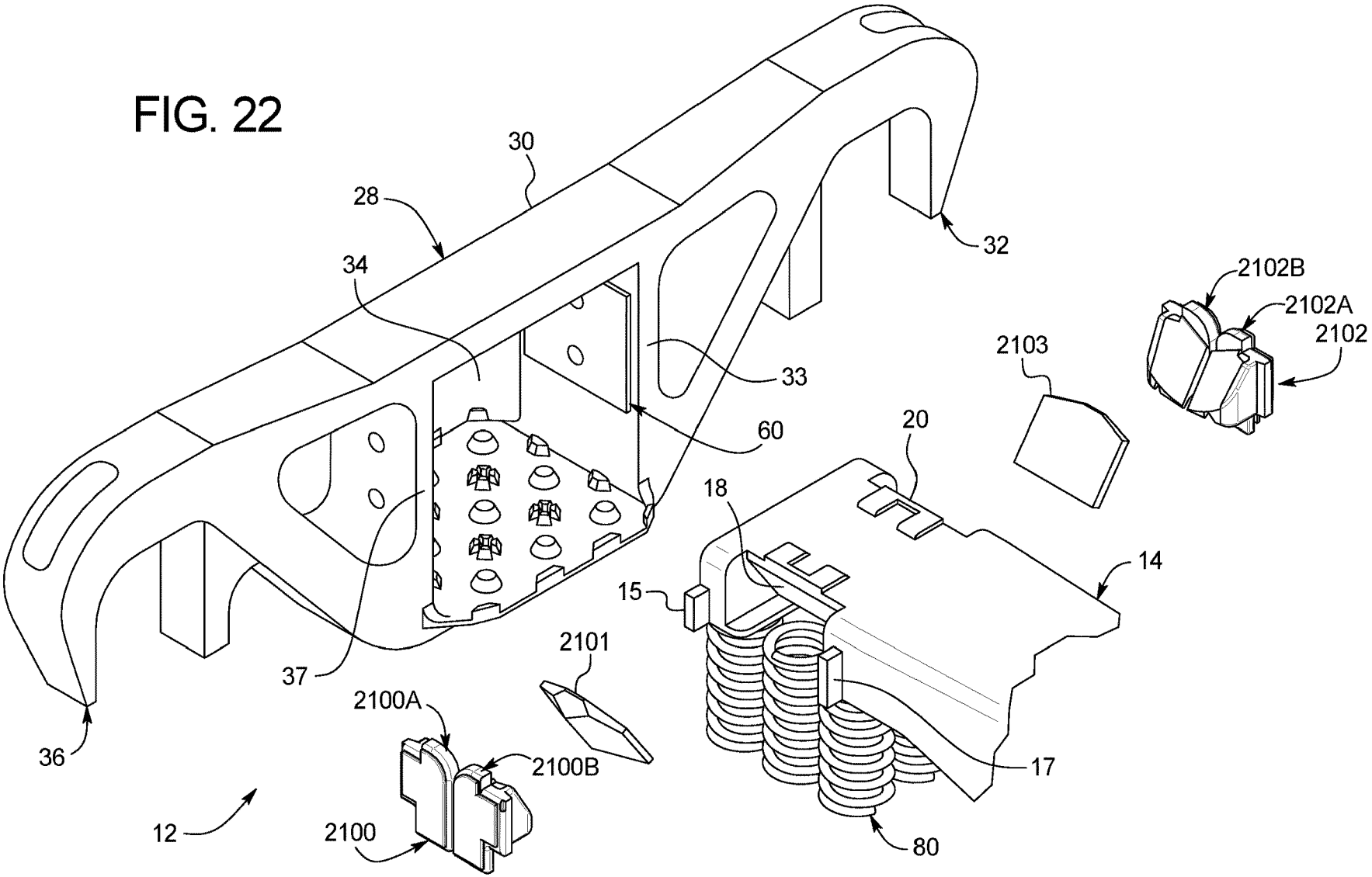

FIG. 22 is an enlarged exploded perspective view of certain components of the railroad car truck of FIG. 21, and illustrating the articulated split friction wedge assembly of FIG. 21 (shown in each of two separate respective locations relative to the bolster (shown in fragmentary) and one of the side frames of the railroad car truck).

Figure 23:
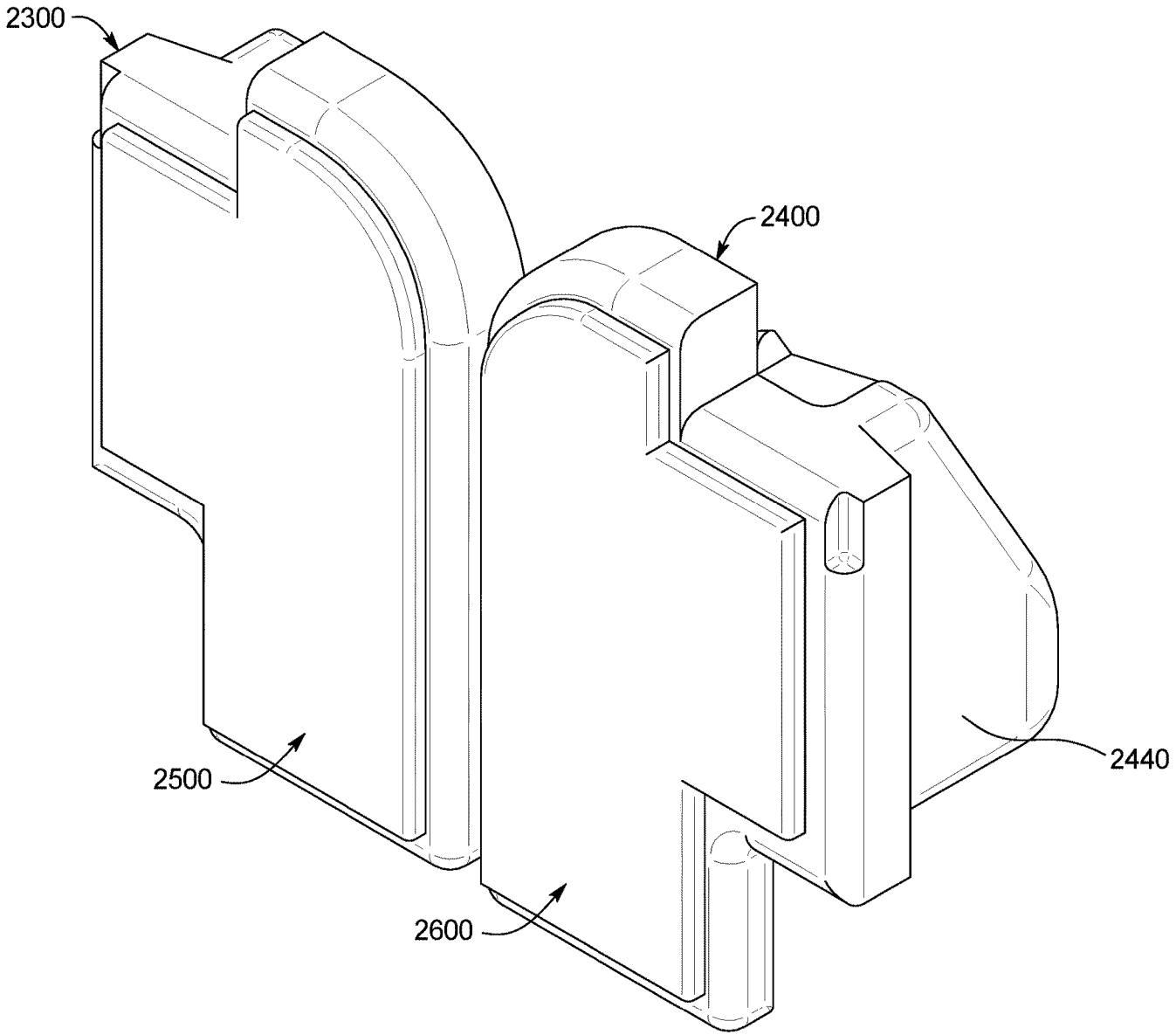

FIG. 23 is a further enlarged front perspective view of one of the articulated split friction wedge assemblies of FIG. 21, and illustrating the two articulated split friction wedges of that articulated split friction wedge assembly.

Figure 24:
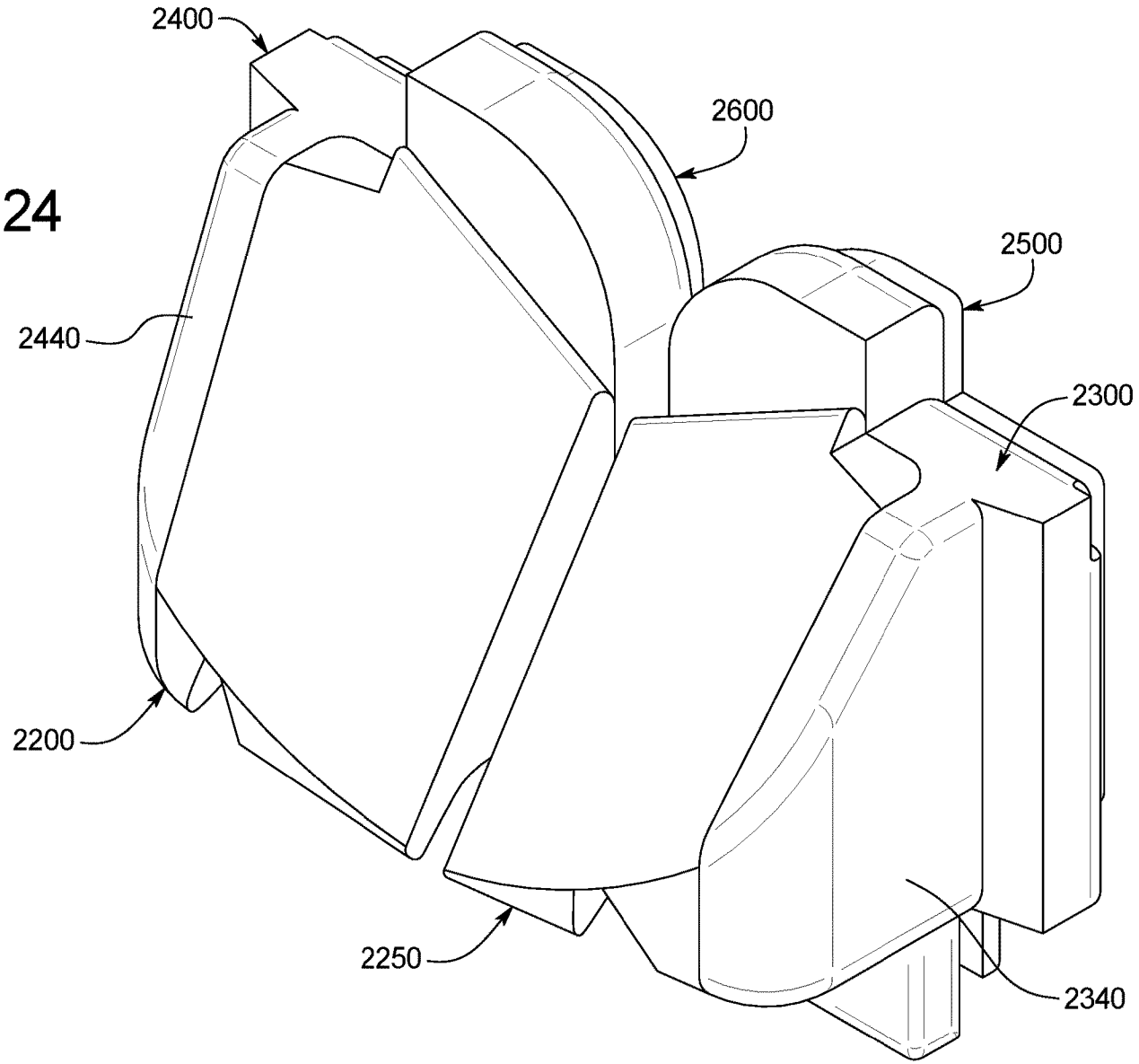

FIG. 24 is an enlarged rear perspective view of the two articulated split friction wedges of FIG. 23.

Figure 25:
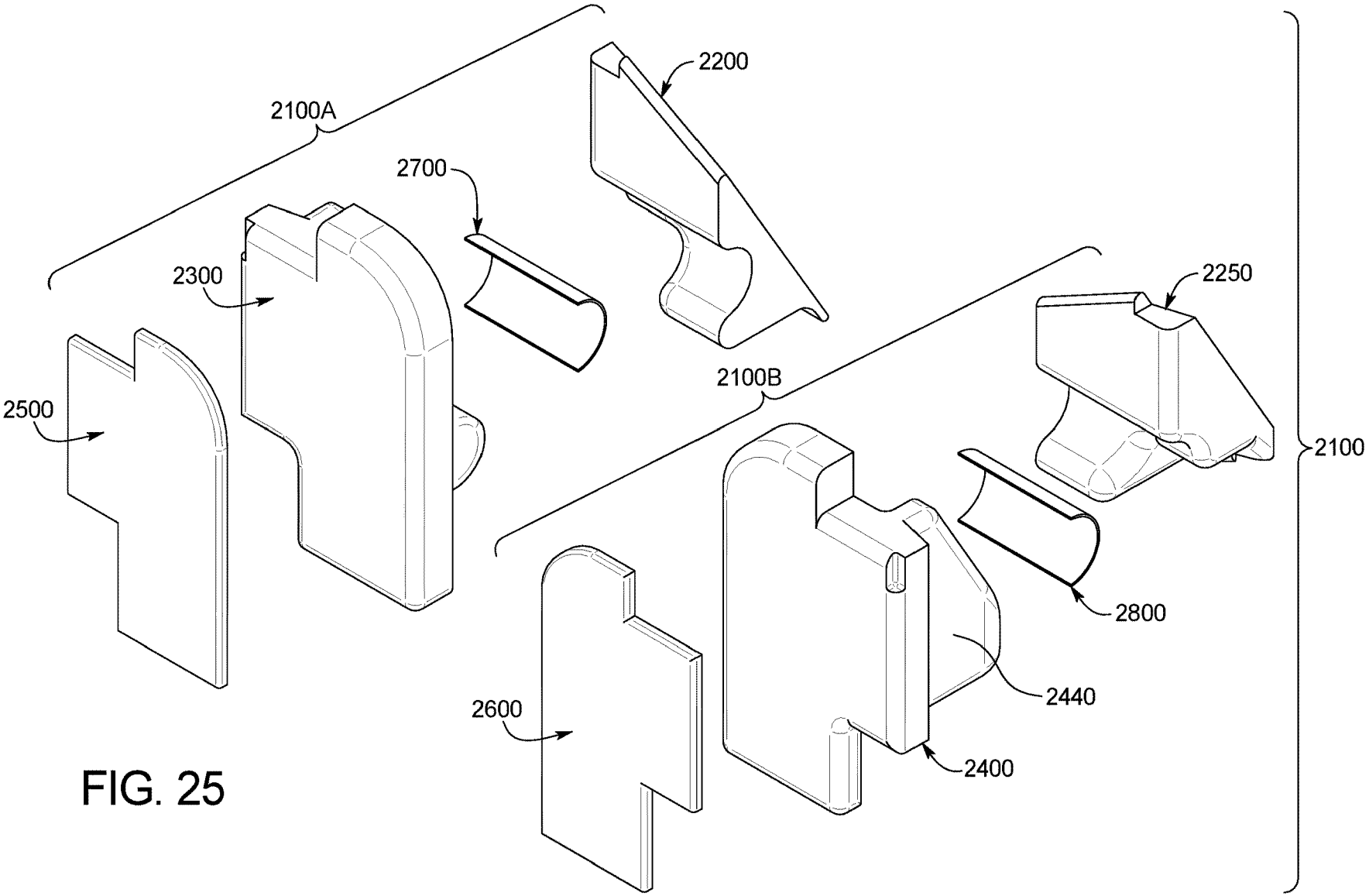

FIG. 25 is an enlarged front exploded perspective view of the two articulated split friction wedges of FIG. 23.

Figure 26:
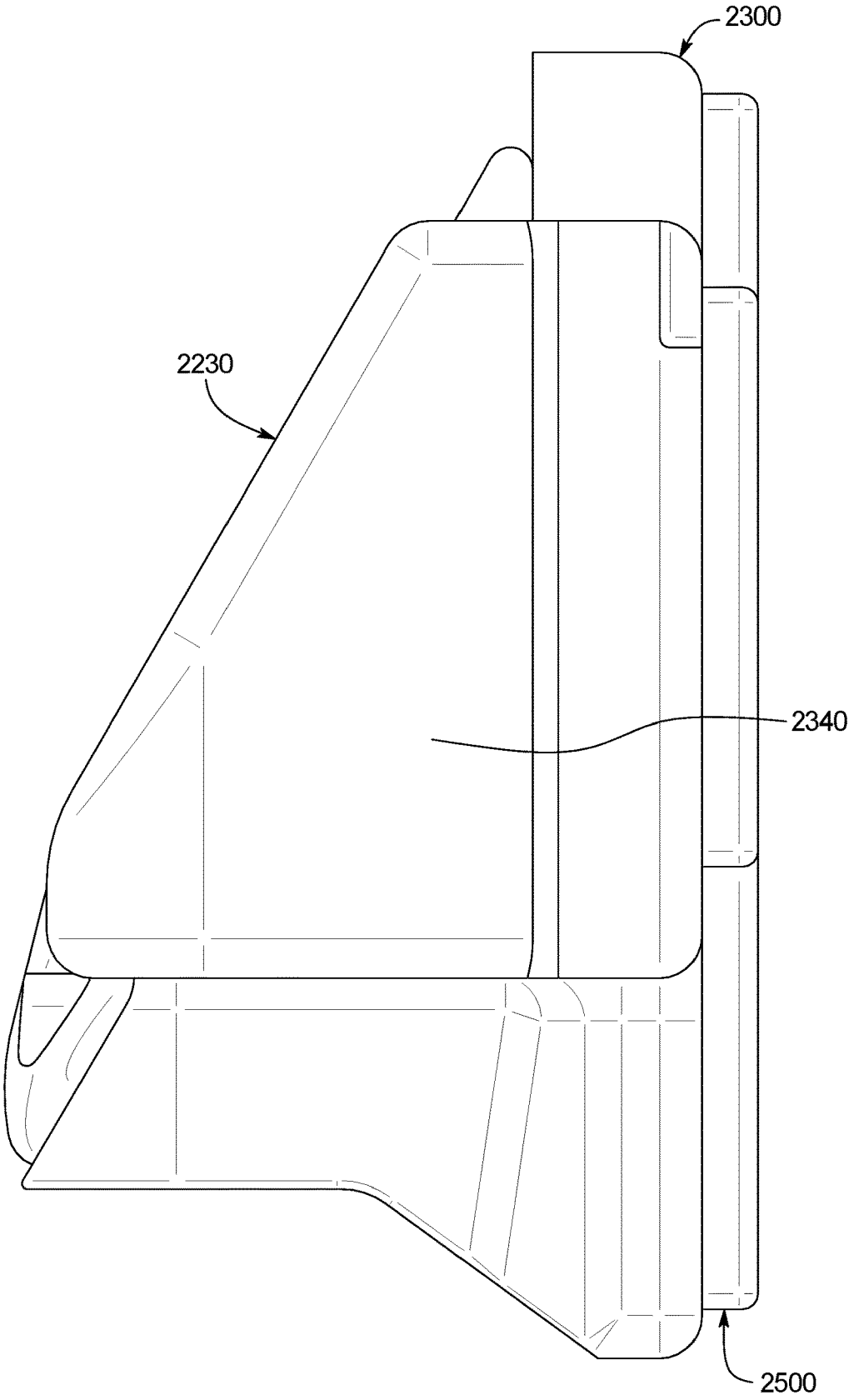

FIG. 26 is an enlarged side view of one of the articulated split friction wedges of FIG. 23.

Figure 27:
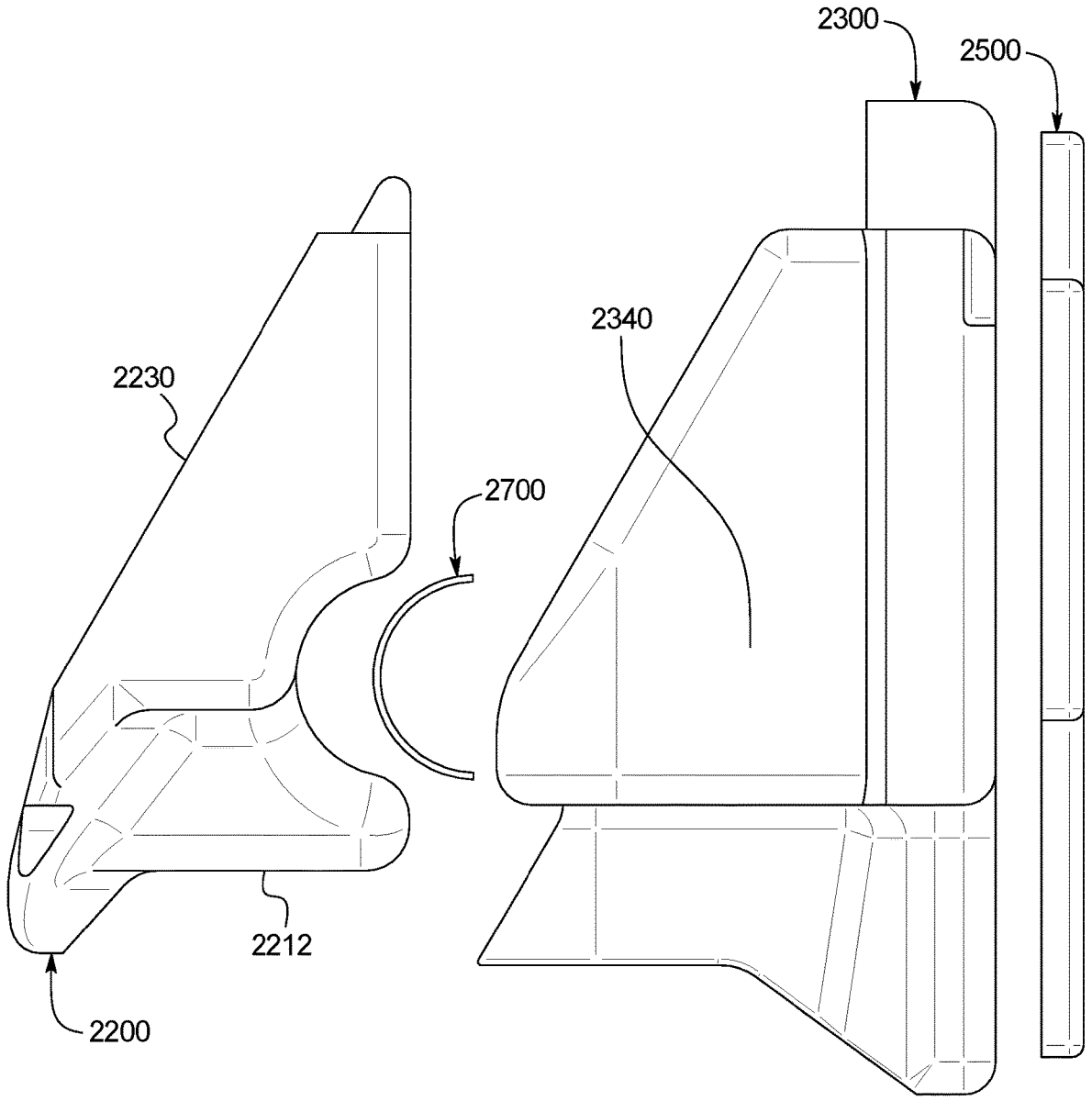

FIG. 27 is an enlarged side exploded view of one of the articulated split friction wedges of FIG. 23.

Figure 28:
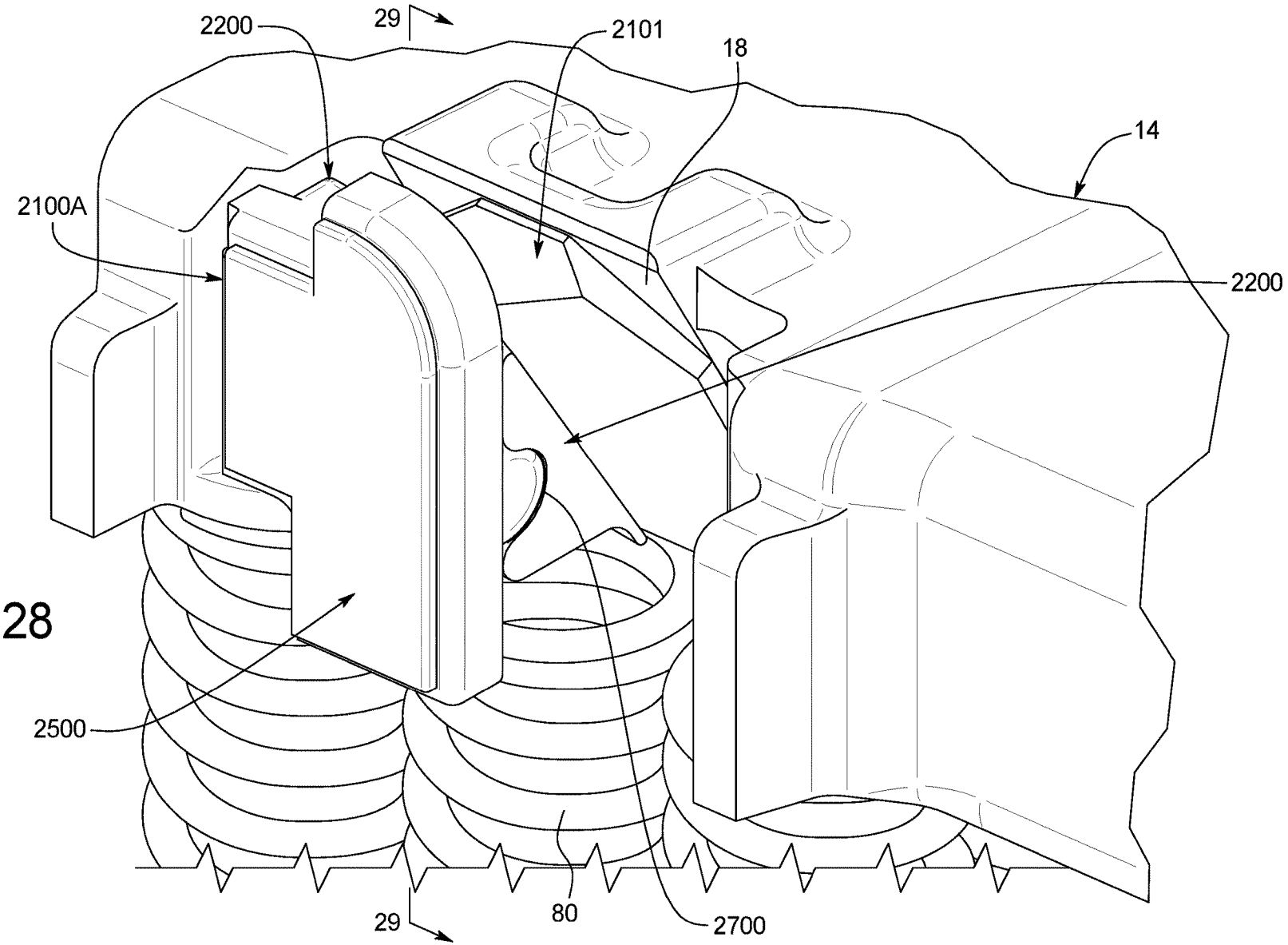

FIG. 28 is an enlarged partial perspective view of one of the articulated split friction wedges of the articulated split friction wedge assembly of FIG. 23 illustrated in position relative to the bolster (shown in fragmentary) and one of the springs (shown in fragmentary) of the railroad car truck.

Figure 29:
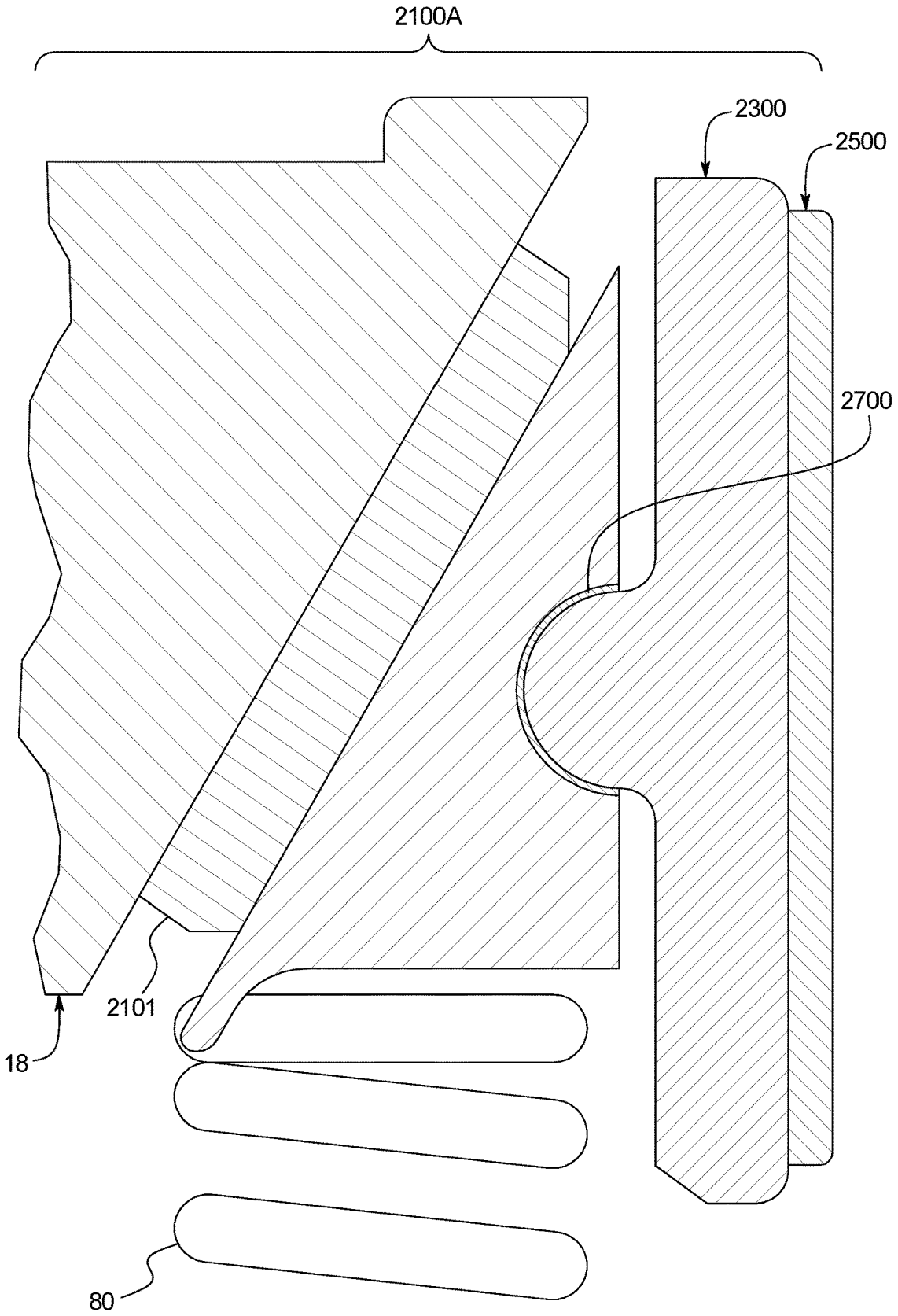

FIG. 29 is an enlarged cross-sectional view of one of the articulated split friction wedges of the articulated split friction wedge assembly of FIG. 23 taken substantially along line 29-29 of FIG. 28 and illustrated in position relative to the bolster (shown in fragmentary) and one of the springs (shown in fragmentary) of the railroad car truck.

DETAILED DESCRIPTION

Figure 1:
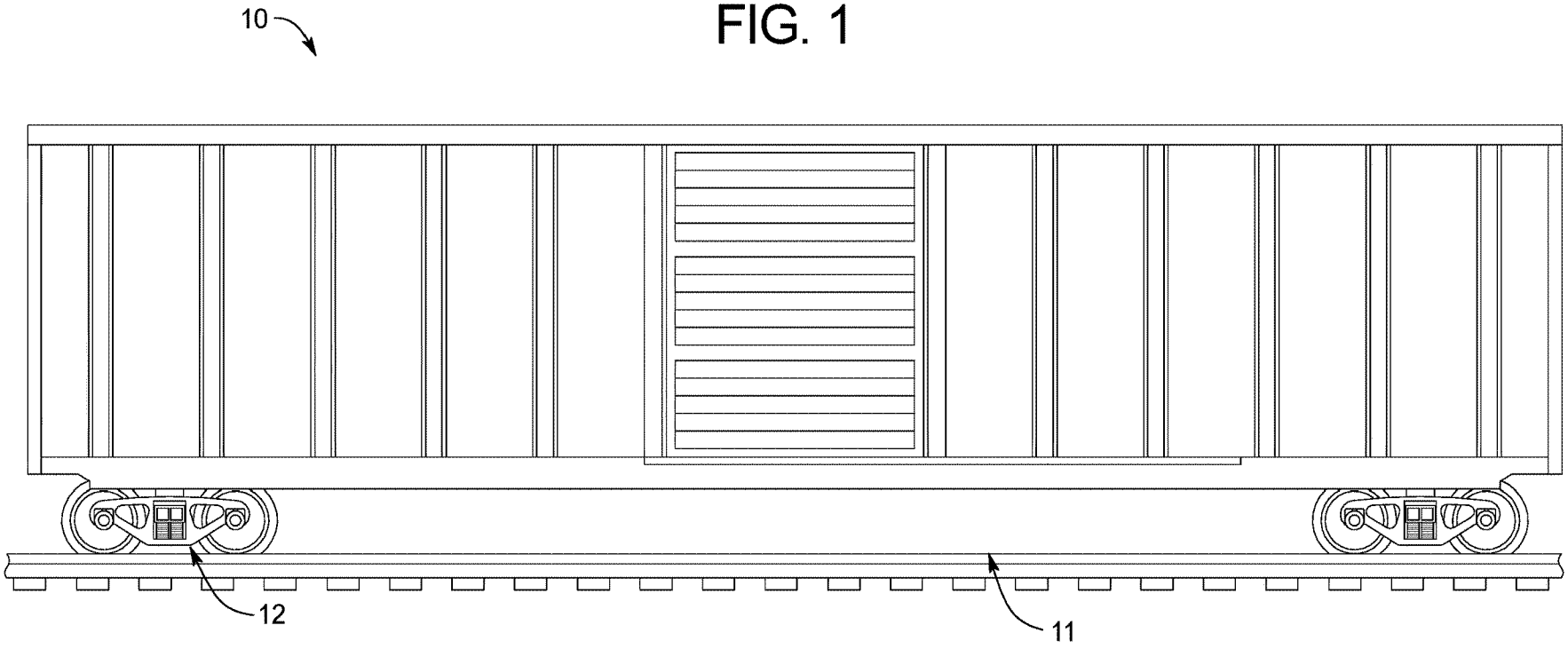
FIG. 1 is a side view of an example freight railroad car of the present disclosure positioned on railroad tracks or rails.
Figure 2:
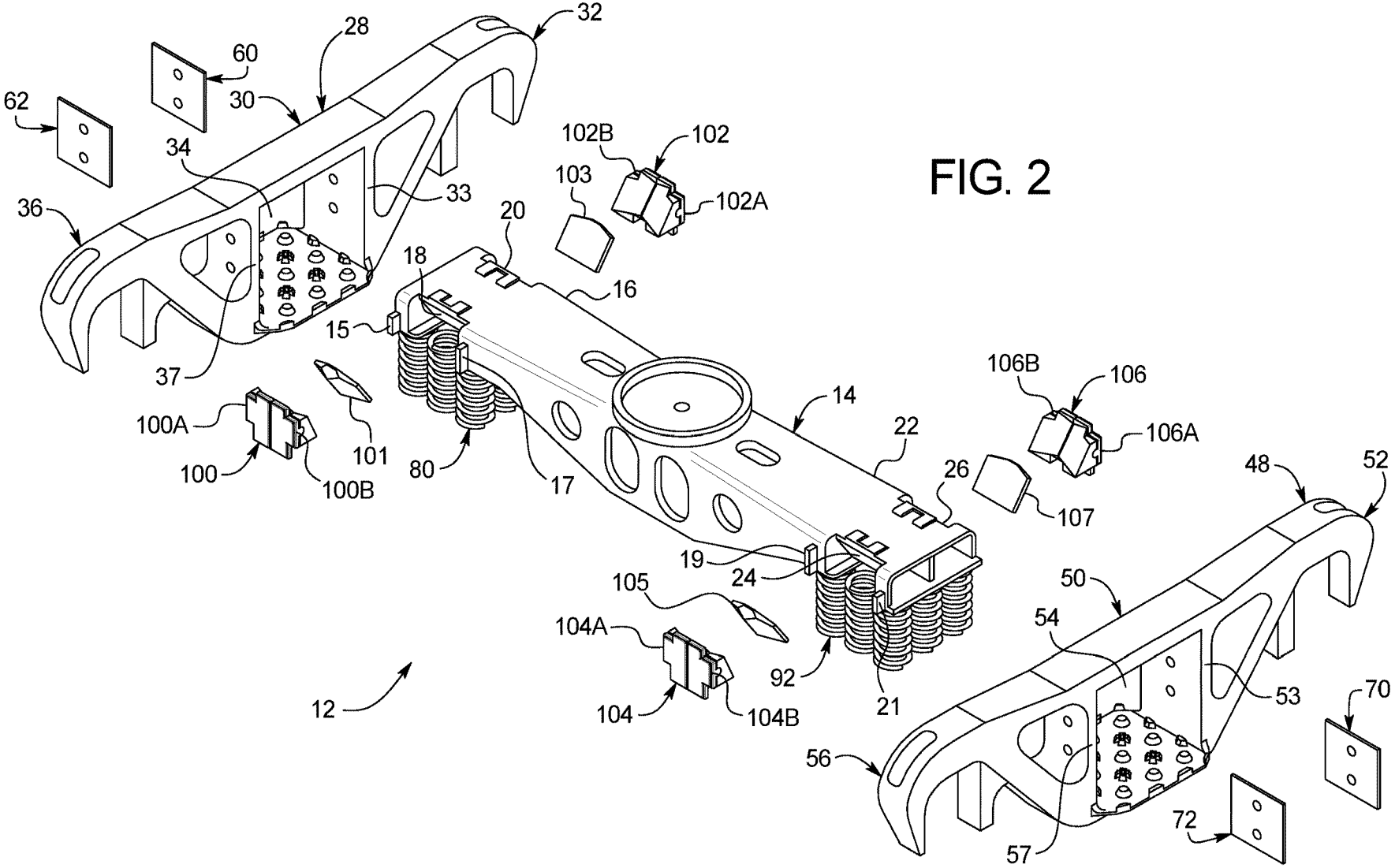
FIG. 2 is an exploded perspective view of certain components of a railroad car truck of one example embodiment of the present disclosure, and illustrating the articulated split friction wedge assembly of one example embodiment of the present disclosure (shown in each of four separate respective locations relative to the bolster and side frames of the railroad car truck).
Figure 3:
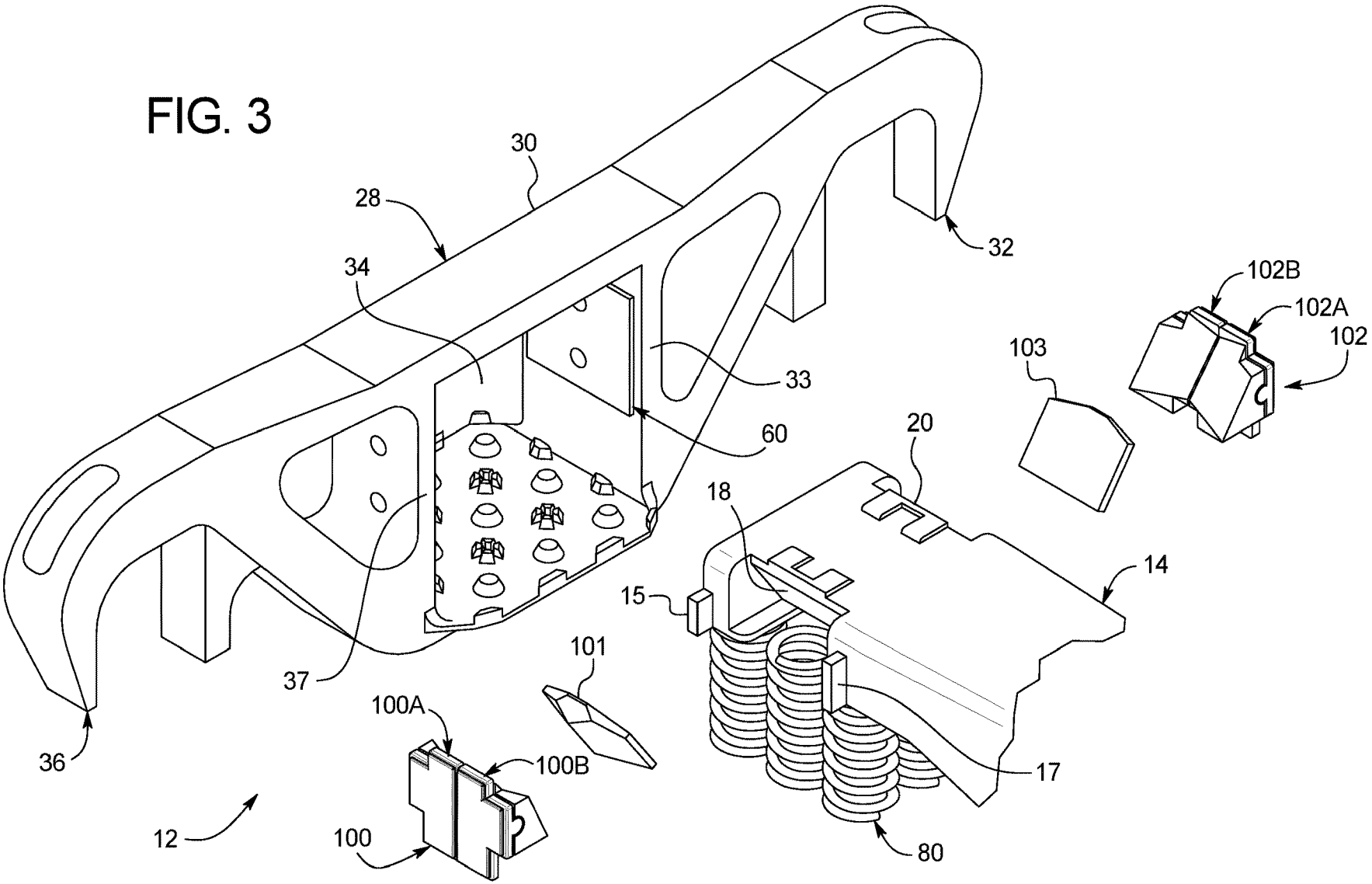
FIG. 3 is an enlarged exploded perspective view of certain components of the railroad car truck of FIG. 2, and illustrating the articulated split friction wedge assembly of FIG. 2 (shown in each of two separate respective locations relative to the bolster (shown in fragmentary) and one of the side frames of the railroad car truck).

Referring now to the drawings and particularly to FIGS. 1 to 11C, one example embodiment of the articulated split friction wedge assemblies of the present disclosure are generally indicated by numerals 100, 102, 104, and 106 (as best shown in FIGS. 2 and 3) and shown with respect to a truck 12 of a freight railroad car 10 configured to roll along railroad tracks or rails 11. The railroad car of the present disclosure may include one or more trucks with the articulated split friction wedge assemblies of the present disclosure. Each truck of the present disclosure may include one or more articulated split friction wedge assemblies of the present disclosure. In various embodiments, a truck will include four articulated split friction wedge assemblies of the present disclosure as generally shown in FIGS. 2 and 3. Each of the example articulated split friction wedge assemblies of the present disclosure that are generally indicated by numerals 100, 102, 104, and 106 includes two articulated split friction wedges generally and respectively indicated by numerals 100A and 100B, 102A and 102B, 104A and 104B, and 106A and 106B.

For brevity, the articulated split friction wedge assembly of the present disclosure may sometimes be referred to herein as the split friction wedge assembly, the articulated friction wedge assembly, the friction wedge assembly, or just the wedge assembly. For brevity, each articulated split friction wedge of an articulated split friction wedge assembly of the present disclosure may sometimes be referred to herein as the split friction wedge, the articulated friction wedge, the friction wedge, or just the wedge. It should be appreciated that such abbreviations are not meant to limit the scope of the present disclosure.

In this example illustrated embodiment, the truck 12 generally includes a bolster 14 and two spaced apart generally parallel side frames 28 and 48. The bolster 14 extends transversely or laterally to the direction of the railroad tracks or rails 11. The side frames 28 and 48 each extend longitudinally or generally in the same direction as straight railroad tracks or rails 11.

Side frame 28 generally includes a body 30 having two spaced downwardly extending pedestal jaws including a first pedestal jaw 32 and a second pedestal jaw 36 on the opposite sides of the central opening 34 of the side frame 28. The first pedestal jaw 32 and the second pedestal jaw 36 of the first side frame 28 respectively include a pair of spaced apart generally vertically extending columns 33 and 37. The truck 12 includes: (a) a generally planar wear plate 60 connected to the interior surface of column 33; and (b) a generally planar wear plate 62 connected to the interior surface of column 37.

Likewise, side frame 48 generally includes a body 50 having two downwardly extending pedestal jaws including a first pedestal jaw 52 and a second pedestal jaw 56 on the opposite sides of the central opening 54 of the side frame 48. The first pedestal jaw 52 and the second pedestal jaw 56 of the second side frame 48 respectively include a pair of spaced apart generally vertically extending columns 53 and 57. The truck 12 includes: (a) a generally planar wear plate 70 connected to the interior surface of column 53; and (b) a generally planar wear plate 72 connected to the interior surface of column 57.

The bolster 14 generally includes two opposite ends 16 and 22 that are respectively positioned in central opening 34 defined by side frame 28 and central opening 54 defined by side frame 48. End 16 of the bolster 14 is vertically supported by a plurality of helical coil suspension springs or spring groups 80. The suspension springs 80 are resiliently compressible to thereby enable the end 16 of the bolster 14 to move vertically upwardly and downwardly within the opening 34 and with respect to the side frame 28. Likewise, end 22 of the bolster 14 is vertically supported by a plurality of helical coil suspension springs or spring groups 92. The suspension springs 92 are resiliently compressible to thereby enable the end 22 of the bolster 14 to move vertically upwardly and downwardly within the opening 54 and with respect to the side frame 48.

In various embodiments, the end 16 of the bolster 14 includes a rearwardly facing inclined wall 18 configured to receive or accept an insert such as insert 101 that has a plurality of rearwardly facing inclined walls configured to engage or be engaged by a friction wedge assembly 100 of the present disclosure and particularly by the friction wedges 100A and 100B of the friction wedge assembly 100. In various embodiments, the end 16 of the bolster 14 also includes a forwardly facing inclined wall 20 configured to receive or accept an insert such as insert 103 that has a plurality of forwardly facing inclined walls configured to engage or be engaged by a friction wedge assembly 102 of the present disclosure and particularly by the friction wedges 102A and 102B of the friction wedge assembly 102. Likewise, in various embodiments, the end 22 of the bolster 14 includes forwardly and rearwardly facing inclined sets of walls collectively labeled 24 and collectively labeled 26 that are each configured to receive or accept a respective insert such as inserts 105 and 107 that each have a plurality of forwardly and rearwardly facing inclined walls configured to engage or be engaged by a respective friction wedge assembly of the present disclosure such as friction wedge assemblies 104 and 106.

In various other embodiments such as shown in FIGS. 2, 3, and 10, suitable bolster pocket inserts such as bolster pockets inserts 101, 103, 105, and 107 are employed such that the plurality of rearwardly and forwardly facing inclined walls of the bolster 14 are each configured to engage or be engaged by the respective bolster pocket insert which is in turn configured to engage or be engaged by the respective friction wedge assembly 100 of the present disclosure and particularly by one of the friction wedges of the respective friction wedge assembly.

Although not shown, the truck 12 includes other conventional components as will be readily appreciated by one of ordinary skill in the art.

Thus, it should be appreciated that articulated split friction wedge assembly of one example embodiment of the present disclosure are shown used in four separate places for the truck 12 in this illustrated embodiment, and indicated by numerals 100, 102, 104, and 106 For brevity, only articulated split friction wedge assembly 100 will be discussed in detail. In this illustrated example embodiment, the articulated split friction wedge assemblies 100, 102, 104, and 106 are identical.

As best shown in FIGS. 4 to 10, the illustrated example articulated split friction wedge assembly 100 generally includes: (a) a first body 200; (b) a second body 250; (c) a first decoupling low coefficient of friction insert 700; (d) a second decoupling low coefficient of friction insert 800; (e) a first pivot member 300 pivotally moveable with respect to the first body 200 and the first decoupling insert 700; (f) a second pivot member 400 pivotally moveable with respect to the second body 200 and the second decoupling insert 800; (g) a first wear pad 500 removably attached to the first pivot member 300; and (h) a second wear pad 600 removably attached to the second pivot member 400. The first body 200, the first decoupling insert 700, the first pivot member 300, and the first wear pad 500 comprise the first articulated split friction wedge 100A of the articulated split friction wedge assembly 100. The second body 250, the second decoupling insert 800, the second pivot member 400, and the second wear pad 600 comprise the second articulated split friction wedge 100B of the articulated split friction wedge assembly 100.

The friction wedge assembly 100 is configured to be positioned in a railroad car truck 12 as generally shown in FIGS. 2, 3, and 10 such that: (a) the body 200 rests on and is supported by one or more of the suspension springs 80; (b) the body 200 engages the respective downwardly inclined wall 18 of the bolster 14 (or a suitable insert such as insert 101 there between); (c) the first wear pad 500 independently engages the respective wear plate 62 attached to the respective column 37 of the respective side frame 28; and (d) the body 200 receives the decoupling low coefficient of friction insert 700 which in turn receives pivot member 300. Likewise, the friction wedge assembly 100 is also configured to be positioned in a railroad car truck 12 such that: (a) the body 250 rests on and is supported by one or more of the suspension springs 80; (b) the body 250 engages the respective downwardly inclined wall 18 of the bolster 14 (or a suitable insert such as insert 101 there between); (c) the second wear pad 600 independently engages the respective wear plate 62 attached to the respective column 37 of the respective side frame 28; and (d) the body 250 receives the decoupling low coefficient of friction insert 800 which in turn receives the pivot member 400. Thus, it should be appreciated that: (i) the body 200 and pivot member 300 are coupled such that the pivot member 300 can translate laterally relative to body 200; (ii) body 250 and the pivot member 400 are coupled such that the pivot member 400 can translate laterally relative to body 250; (iii) the bolster gibs 15 and 17 shown in FIGS. 2 and 3 can limit the lateral motion, typically between ⅜ inches to ½ inches when contacting column 37; (iv) the bodies 200 and 250 generally stay with the bolster; and (v) the pivot members 300 and 400 generally slide with the side frames.

This arrangement or configuration enables the articulated split friction wedge assembly 100 to perform its various functions and to provide required damping, provide high warp restraint, reduce binding, and enable lateral decoupling. This configuration also enables the articulated split friction wedge assembly 100 to (along with the other articulated split friction wedge assemblies 102, 104, and 106): (a) reduce wheel wear and damage; (b) reduce rolling resistance; (c) reduce fuel consumption; (d) reduce the need for and thus cost of railroad track repair; (e) reduce truck hunting and improve HSS for both empty and loaded freight railroad cars; (f) reduce truck hunting; and (g) improve curving performance for both empty and loaded freight railroad cars.

More specifically, in this illustrated example embodiment as best shown in FIGS. 4, 5, 6, 7, 8, 9, and 10, the body 200 is generally triangular or wedge-shaped. The body 200 generally includes: (a) a base or base portion 210; (b) an inclined insert engager or engager portion 230 integrally formed with, connected to, and extending upwardly at an acute angle from the base 210; and (c) a pivot pin receiver or receiver portion 240 integrally formed with, connected to, and extending upwardly from the base 210 and integrally formed with, connected to, and extending laterally from the inclined bolster engager 230.

The base 210 of the body 200 includes a generally horizontally extending bottom wall 212. The bottom wall 212 has: (a) a downwardly facing bottom surface (not labeled); (b) an inwardly facing edge (not labeled); (c) an outwardly facing edge (not labeled); (d) a first side edge (not labeled); and (e) a second side edge (not labeled). The bottom wall 212 and particularly the downwardly facing bottom surface is configured to rest on and engage the top of one or more suspension springs 80 as generally shown in FIGS. 9 and 10.

The inclined bolster engager 230 of the body 200 has: (a) a outwardly facing upwardly inclined surface 232; (b) a top edge (not labeled); (c) a bottom edge (not labeled); (d) a first side edge (not labeled); and (e) a second side edge (not labeled). The inclined surface 232 is configured to engage one of the downwardly inclined walls of the bolster 14 such as downwardly inclined wall 18 (or an insert such as insert 101 there between). The inclined surface wall 232 extends at an inclined angle of approximately 32 degrees, although other angles can be used, within the range of 30-45 degrees, to the base 210 in this illustrated example embodiment.

The pivot pin receiver or receiver portion 240 of the body 200 extends from the base 210 and the inclined bolster engager 230. The pivot pin receiver or receiver portion 240 defines a socket. In this illustrated example embodiment, the socket has open ends and is continuous across body 200, enabling unrestricted lateral motion of pivot member 300. More specifically, the pivot pin receiver or receiver portion 240 includes: (a) a concave or semi-cylindrical surface 242 that generally defines the socket; (b) a first side edge (not labeled); and (c) a second side edge (not labeled).

The socket is configured to pivotally receive the decoupling insert 700 and the respective pivot pin 350 that extends inwardly from the first pivot member 300 as further explained below. The decoupling insert 700 that lies between body 200 and the pivot pin 350 of the pivot member 300 reduces wear and decrease lateral frictional resistance between the body 200 and pivot member 300. This also enables the pivot pin 350 and the first pivot member 300 to independently pivot with respect to the body 200 and with respect to body 250 and the second pivot member 400.

It should also be appreciated that the decoupling insert 800 functions similarly to decoupling insert 700. It should also be appreciated that in various embodiments, the decoupling inserts 700 and 800 and/or the bodies 200 and 250 can have one or more retaining mechanisms (not shown) to hold the decoupling inserts 700 and 800 in the desired positions relative to the bodies 200 and 250. It should also be appreciated that in various embodiments, the decoupling inserts 700 and 800 and/or the pivot member 300 and 400 can have one or more retaining mechanisms (not shown) to hold the decoupling inserts 700 and 800 in the desired positions relative to the pivot members 300 and 400.

The body 200 of the articulated split friction wedge 100A (including the base or base portion 210, the inclined insert engager or engager portion 230, and the pivot pin receiver or receiver portion 240 in this illustrated embodiment is made from a cast iron or steel. It should be appreciated that the body may be made from other materials (such as other metals, plastics, or composite materials) in accordance with the present disclosure. It should also be appreciated that the body may be made from two or more pieces that are connected together.

The body 250 is generally a mirror image of body 200 and thus similarly includes: (a) a base or base portion (not labeled); (b) an inclined insert engager or engager portion (not labeled) integrally formed with, connected to, and extending upwardly at an acute angle from the base; and (c) a pivot pin receiver or receiver portion (not labeled) integrally formed with, connected to, and extending upwardly from the base and integrally formed with, connected to, and extending laterally from the inclined bolster engager.

It should be appreciated that the bodies 200 and 250 are thus configured to fit together in the bolster pocket defined by the bolster 14 as generally indicated by FIGS. 2, 3, 9, and 10. It should be appreciated that the bodies 200 and 250 are configured to operate together and to move independently of each other. It should be further be appreciated that the bodies 200 and 250 are configured to engage the bolster pocket side walls or surfaces of a suitable side wall wear plate (not shown). It should be appreciated that the bodies 200 and 250 are configured to engage an insert such as insert 101 positioned in the wedge pocket defined by the bolster 14 as shown in FIGS. 2, 3, 9 and 10. It should be appreciated that the outer walls or surfaces of the insert such as insert 101 and the corresponding inclined walls or surfaces (such as surface 232 of the body 200) can have matching or co-acting lateral or transverse angles to cause the urging of the bodies 200 and 250 apart from each other during operation. These transverse angles of the incline walls or surfaces of the bodies are best shown in FIGS. 5 and 6. It should be appreciated that the angles of incline may vary in accordance with the present disclosure.

In this illustrated example embodiment, the first pivot member 300 generally includes an upstanding wall 310 and a pivot pin 350 integrally connected to and extending inwardly from the wall 310.

The wall 310 generally includes a generally rectangular first portion 320 and a smaller generally rectangular second portion 340 extending from the side of the first portion 320.

The first portion 320 of the wall 310 has: (a) a front face; (b) an inwardly facing back face; (c) a top edge; (d) a bottom edge; (e) a first side edge; and (f) a second side edge.

The second portion 330 of the wall 310 has: (a) a front face; (b) an inwardly facing back face; (c) a top edge; (d) a bottom edge; (e) a first side edge; and (f) a second side edge.

In an alternative embodiment, the front face of the wall of the first pivot member 300 defines a pocket (not shown) that is configured to partially receive and hold the first wear member pad 500. In one such embodiment, the pocket includes a generally planar bottom wall (not shown) and peripheral side wall (not shown) that extend substantially around the entire perimeter of the bottom wall. In one such embodiment, the peripheral side walls include a rim (not shown) that is located generally coplanar with the front face. In one such embodiment, the peripheral side walls extends substantially around the peripheral side wall of the wear pad and substantially cover the peripheral side wall of the wear pad. The peripheral side walls thereby protect the wear pad from being damaged after installation and during use by any foreign objects that may otherwise strike and damage the wear pad.

The pivot pin 350 of the first pivot member 300 includes a semi-cylindrical body that is integrally formed with the wall 310 in this illustrated example embodiment. In other embodiments, the pivot pin can be separately formed and attached to the wall 310. The pivot pin 350 is configured to fit into and pivot in the insert 700 which is in the socket defined by surface 242 of the pivot pin receiver or receiver portion 240 of the body 200.

In this illustrated example embodiment, the second pivot member 400 generally includes an upstanding wall 410 and a pivot pin 450 integrally connected to and extending inwardly from the wall 410.

The wall 410 includes a generally rectangular first portion 420 and a smaller generally rectangular second portion 440 extending from the side of the first portion 420.

The first portion 420 of the wall 410 has: (a) a front face; (b) an inwardly facing back face; (c) a top edge; (d) a bottom edge; (e) a first side edge; and (f) a second side edge.

The second portion 430 of the wall 410 has: (a) a front face; (b) an inwardly facing back face; (c) a top edge; (d) a bottom edge; (e) a first side edge; and (f) a second side edge.

In an alternative embodiment, the front face of the wall of the second pivot member 400 defines a pocket (not shown) that is configured to partially receive and hold the first wear member pad 400. In one such embodiment, the pocket includes a generally planar bottom wall (not shown) and peripheral side wall (not shown) that extend substantially around the entire perimeter of the bottom wall. In one such embodiment, the peripheral side walls include a rim (not shown) that is located generally coplanar with the front face. In one such embodiment, the peripheral side walls extends substantially around the peripheral side wall of the wear pad and substantially cover the peripheral side wall of the wear pad. The peripheral side walls thereby protect the wear pad from being damaged after installation and during use by any foreign objects that may otherwise strike and damage the wear pad.

The pivot pin 450 of the first pivot member 400 includes a semi-cylindrical body that is integrally formed with the wall 410 in this illustrated example embodiment. In other embodiments, the pivot pin can be separately formed and attached to the wall 410. The pivot pin 450 is configured to fit into and pivot in the insert 800 which is in socket defined by the wall of the pivot pin receiver or receiver portion of the body 250.

In this illustrated example embodiment, the first wear pad 500 generally includes a wall 510 including a generally rectangular first portion 520 and a smaller generally rectangular second portion 540 extending from the side of the first portion 520.

The first portion 520 of the wall 510 of the first wear pad 500 has: (a) a front face; (b) an inwardly facing back face; (c) a top edge; (d) a bottom edge; (e) a first side edge; and (f) a second side edge.

The second portion 530 of the wall 510 of the first wear pad 500 has: (a) a front face; (b) an inwardly facing back face; (c) a top edge; (d) a bottom edge; (e) a first side edge; and (f) a second side edge.

In various embodiments, the first wear pad 500 is connected to the wall 310 of the first pivot member 300 by one or more suitable wear pad connection members (not shown) as generally described below.

In this illustrated example embodiment, the second wear pad 600 generally includes a wall 610 including a generally rectangular first portion 620 and a smaller generally rectangular second portion 640 extending from the side of the first portion 620.

The first portion 620 of the wall 610 of the first wear pad 600 has: (a) a front face; (b) an inwardly facing back face; (c) a top edge; (d) a bottom edge; (e) a first side edge; and (f) a second side edge.

The second portion 630 of the wall 610 of the second wear pad 600 has: (a) a front face; (b) an inwardly facing back face; (c) a top edge; (d) a bottom edge; (e) a first side edge; and (f) a second side edge.

In various embodiments, the first wear pad 600 is connected to the wall 410 of the second pivot member 400 by one or more suitable wear pad connection members (not shown) as generally described below.

In various embodiments, each wear pad connection member includes an adhesive (not shown) or one or more adhesive layers (not shown). In certain such embodiments, the adhesive or adhesive layer extends uniformly over the entire area of the rear or back surface wall of the wear pad. In other such embodiments, the adhesive or adhesive layer is applied to certain sections of the wall such that the adhesive or adhesive layer does not completely cover the rear or back surface of the wall. The adhesive or adhesive layer is configured to removably attach the wear pad to the front face of the walls of the respective first or second pivot member with a desired adhesive bond strength. The adhesive or adhesive layer is adapted to retain the wear pads respectively to the first and second pivot member during installation of the friction wedge in the railroad car truck. The adhesive or adhesive layer is also adapted to enable the wear pads to be relatively easily detached from the first and second pivot members when desired (such as when the wear pad is worn, damaged, or replaced for preventive maintenance).

In various other embodiments, the wear pad connection members include a combination of an adhesive (not shown) or one or more adhesive layers (not shown) and one or more mechanical fasteners (not shown).

The first and second wear pads 500 and 600 of the articulated split friction wedge 100 in this illustrated embodiment are made from a composite material, and particularly with a coefficient of friction between 0.30-0.45. It should be appreciated that the first and second wear pads 500 and 600 may be made from other material (such as metals, plastics, or other composite materials) in accordance with the present disclosure. It should be appreciated that the articulated split wedge may be utilized without wear pads.

It should be appreciated the decoupling low coefficient of friction inserts 700 and 800 may be made from a suitable low coefficient of friction material such as but not limited to a suitable composite material, a polyethylene, a polypropylene, or an acetal homopolymer resin such as DuPont's Delrin® highly-crystalline engineering thermoplastic material. It should be appreciated that in various embodiments, the decoupling low coefficient of friction inserts 700 and 800 have a coefficient of friction lower than wear pads 500 and 600, and preferably in the range of 0.06-0.10. In other words, the decoupling inserts 700 and 800 facilitate or allow lateral movement of the pivot members 300 and 400 relative to the bodies 200 and 250, thereby decoupling the side frames and bolster. This assists in reducing or limiting lateral wheel set displacements (oscillations) and thus accelerations into the car body, thereby increasing high speed truck stability.

In this illustrated example embodiment, the pivot members 300 and 400 and the wear pads 500 and 600 of the articulated split friction wedge 100 have an overall assembled width of approximately 6.5 inches. It should be appreciated various articulated split wedge arrangements may be adapted to fit into existing freight car trucks, where the overall assembled width can be greater than or less than 6.5 inches.

As indicated above, the friction wedge assembly 100 is configured to be positioned in a railroad car truck 12 as generally shown in FIGS. 2, 3, 9, and 10 such that one or more of the suspension springs 80 support and engage the bottom surfaces of the bases of the bodies 200 and 250, and such that the surfaces of the respective upwardly inclined surfaces of the bodies 200 and 250 engage the downwardly inclined surface 18 of the bolster 14 (or an insert such as insert 101 there between). The suspension springs 80 and the downwardly inclined walls 18 of the bolster 14 (and the insert 101 when employed) thereby force the wear pads 500 and 600, and specifically the front or outer surfaces of the wear pads 500 and 600, into engagement with the wear plate 62 attached to the column 37 of the side frame 28 in this illustrated example embodiment. The wear pads 500 and 600 of the friction wedge 100 slide generally upwardly and downwardly in engagement with the wear plate 62 as the bolster 14 moves upwardly and/or downwardly within the window or central opening 34 of the side frame 28. The frictional force generated between the wear pads 500 and 600 and the wear plate 62 dampens the movement of the bolster 14 and specifically the end 16 of the bolster 14 within the window or central opening 34 relative to the side frame 28.

Due to the frictional sliding engagement between the wear pads 500 and 600 and the wear plate 62, the wear pads 500 and 600 will become worn over time. When the articulated split friction wedge assembly 100 requires maintenance or refurbishing, the friction wedges 100A and 100B can be removed from the truck 12 and the wear pads 500 and 600 can be replaced. The refurbished articulated split friction wedge assembly 100 may then be reinstalled in the truck 12.

It should be appreciated that the combinations of components or features of the articulated split friction wedge assembly 100 of the present disclosure provide or co-act to provide a combination of various advantages not previously provided by known friction wedges. FIGS. 11A, 11B, and 11C generally illustrate certain of these advantages. FIG. 11A generally illustrates that the individual wedges 100A and 100B can be moved or positioned toward each other for ease of installation. FIG. 11B generally illustrates that the individual wedges 100A and 100B will move or be positioned away from each other in operation. It should be appreciated that the co-acting lateral or transverse angled of the inclined surfaces of the bodies and the insert urge the wedges 100A and 100B outwardly as generally shown in FIG. 11B. This eliminates or reduces the gaps between the wedges 100A and 100B and the respective side walls that define the bolster pocket, and thus also resists or limits rotation of the wedges 100A and 100B. It should be appreciated bodies 200 and 250 will remain mostly against the wall(s) that define the bolster pocket (including the bolster pocket side walls). If the side frames laterally displace, the pivot member 300 and 400 will laterally translate relative to bodies 200 and 250, laterally decoupling the side frames 28 and 48 from the bolster 14. This tends to assist in maintaining truck squaring and stiffness. FIG. 11C generally illustrates that the individual wedges 100A and 100B can independently move or be positioned upwardly and downwardly in operation under warp forces. This upward and downward translation will provide or produces more resistance so that the split wedges 100A and 100B will produce higher warp stiffness. The higher warp stiffness produced by split wedges 100A and 100B will provide a higher truck hunting threshold, will lower wheel wear from curving, and does not reduce damping.

It should further be appreciated that the articulation of bodies 200 and 250 reduces or decreases the tendency for the friction wedge assembly 100 to bind with the planar wear plate 62 connected to the interior surface of the column 37 of the side frame 28. This reduction in binding occurs because the bodies 200 and 250 respectively pivot relative to the pivot members 300 and 400 thereby transferring only or mainly horizontal and/or vertical loads to and/or through the pivot member 300 and 400 (or wear pads 500 and 600 attached thereto), and thus the wear pads 500 and 600 will remain substantially flush with and in contact with the wear plate 62. In other words, high concentrated forces from uneven, or low, friction shoe contact area into the side frame column will be eliminated or significantly reduced, thus improving vertical motion between such components.

It should further be appreciated that the composite material feature of the wear pads 500 and 600 on the vertical face of the articulated split friction wedge assembly 100 reduces or decreases the tendency for the friction wedge assembly 100 to bind with the planar wear plate 62 connected to the interior surface of column 37. In other words, the composite material reduces the coefficient of friction between the side frame and the bolster, and thus reduces binding between such components.

It should further be appreciated that the split feature of the bodies 200 and 250 and the split feature of the pivot members 300 and 400 and the wear pads 500 and 600 of the articulated split friction wedge assembly 100 reduces or decreases the tendency for the friction wedge assembly 100 to bind with the planar wear plate 62 that is connected to the interior surface of column 37.

It should further be appreciated that relatively wide pivot members 300 and 400 and the wear pads 500 and 600 of the articulated split friction wedge 100 reduce or decrease the tendency for the friction wedge 100 to bind with the planar wear plate 62 that is connected to the interior surface of column 37.

It should further be appreciated that the independent articulating feature of the bodies 200 and 250, the pivot members 300 and 400, and the wear pads 500 and 600 of the articulated split friction wedge assembly 100 also evenly distribute loading between the friction wedge and side frame column to reduce a slip-stick.

It should further be appreciated that the independently moveable feature of the bodies 200 and 250, the independent articulating feature of pivot members 300 and 400, and the wear pads 500 and 600 of the articulated split friction wedge assembly 100 distribute a more relatively even pressure on or across the composite material of the wear pads 500 and 600 and the planar wear plate 62 that is connected to the interior surface of column 37, thereby reducing the possibility of high concentrated loads that may break/crush or prematurely wearing the composite material of the wear pads 500 and 600.

It should further be appreciated that the relatively wide pivot members 300 and 400 and the wear pads 500 and 600 of the articulated split friction wedge 100 increase truck warp stiffness.

It should further be appreciated that the decreased angle feature of the pivot member 300 and 400 and the wear pads 500 and 600 of the articulated split friction wedge 100 increases truck warp stiffness.

It should be further appreciated that pivot member 300 and 400 have unrestricted lateral movement relative to bodies 200 and 250, providing lateral displacement capabilities that decouple the side frame lateral motion relative to the bolster 14. In other words, decoupling the side frames and bolster reduces or limits lateral wheel set displacements (oscillations) and thus accelerations into the car body, increasing high speed truck stability.

Referring now to FIGS. 12 to 20, another example embodiment of the articulated split friction wedge assemblies of the present disclosure are generally indicated by numerals 1100, 1102, 1104, and 1106 (as best shown in FIGS. 12 and 13) and shown with respect to a truck 12 of a freight railroad car 10 configured to roll along railroad tracks or rails 11. As with the above described embodiment of the present disclosure, the railroad car of the present disclosure may include one or more trucks with the articulated split friction wedge assemblies of this example embodiment of the present disclosure. As with the above described embodiment of the present disclosure, each truck of the present disclosure may include one or more articulated split friction wedge assemblies of this example embodiment of the present disclosure. In various embodiments, a truck will include four articulated split friction wedge assemblies as generally shown in FIGS. 12 and 13. Each of the example articulated split friction wedge assemblies of the present disclosure that are generally indicated by numerals 1100, 1102, 1104, and 1106 includes two articulated split friction wedges generally and respectively indicated by numerals 1100A and 1100B, 1102A and 1102B, 1104A and 1104B, and 1106A and 1106B.

As with the above described embodiment of the present disclosure shown in FIGS. 2 to 10, in this example illustrated embodiment, the truck 12 generally includes a bolster 14 and two spaced apart generally parallel side frames 28 and 48. The side frame 28 generally includes a body 30 having two spaced downwardly extending pedestal jaws including a first pedestal jaw 32 and a second pedestal jaw 36 on the opposite sides of the central opening 34 of the side frame 28. The first pedestal jaw 32 and the second pedestal jaw 36 of the first side frame 28 respectively include a pair of spaced apart generally vertically extending columns 33 and 37. The truck 12 includes: (a) a generally planar wear plate 60 connected to the interior surface of column 33; and (b) a generally planar wear plate 62 connected to the interior surface of column 37.

As with the above described embodiment of the present disclosure shown in FIGS. 2 to 10, in this example illustrated embodiment, side frame 48 generally includes a body 50 having two downwardly extending pedestal jaws including a first pedestal jaw 52 and a second pedestal jaw 56 on the opposite sides of the central opening 54 of the side frame 48. The first pedestal jaw 52 and the second pedestal jaw 56 of the second side frame 48 respectively include a pair of spaced apart generally vertically extending columns 53 and 57. The truck 12 includes: (a) a generally planar wear plate 70 connected to the interior surface of column 53; and (b) a generally planar wear plate 72 connected to the interior surface of column 57.

As with the above described embodiment of the present disclosure shown in FIGS. 2 to 10, in this example illustrated embodiment, the bolster 14 generally includes two opposite ends 16 and 22 that are respectively positioned in central opening 34 defined by side frame 28 and central opening 54 defined by side frame 48. End 16 of the bolster 14 is vertically supported by a plurality of helical coil suspension springs or spring groups 80. The suspension springs 80 are resiliently compressible to thereby enable the end 16 of the bolster 14 to move vertically upwardly and downwardly within the opening 34 and with respect to the side frame 28. Likewise, end 22 of the bolster 14 is vertically supported by a plurality of helical coil suspension springs or spring groups 92. The suspension springs 92 are resiliently compressible to thereby enable the end 22 of the bolster 14 to move vertically upwardly and downwardly within the opening 54 and with respect to the side frame 48.

In various other embodiments, bolster pocket inserts such as bolster pockets inserts 1101, 1103, 1105, and 1107 are employed in different configurations.

As with the above described embodiment of the present disclosure shown in FIGS. 2 to 10, although not shown, the truck 12 of this example embodiment includes other conventional components as will be readily appreciated by one of ordinary skill in the art.

As with the above described embodiment of the present disclosure shown in FIGS. 2 to 10, it should also be appreciated that articulated split friction wedge assembly of this example embodiment of the present disclosure is shown used in four separate places for the truck 12, and indicated by numerals 1100, 1102, 1104, and 1106 For brevity, only articulated split friction wedge assembly 1100 will be discussed in detail. In this illustrated example embodiment, the articulated split friction wedge assemblies 1100, 1102, 1104, and 1106 are identical.

As best shown in FIGS. 14 to 20, the illustrated example articulated split friction wedge assembly 1100 generally includes: (a) a first body 1200; (b) a second body 1250; (c) a first decoupling low coefficient of friction insert 1700; (d) a second decoupling low coefficient of friction insert 1800; (e) a first pivot member 1300 pivotally moveable with respect to the first body 1200 and the first decoupling insert 1700; (f) a second pivot member 1400 pivotally moveable with respect to the second body 1250 and the second decoupling insert 1800; (g) a first wear pad 1500 attached to the first pivot member 1300; and (h) a second wear pad 1600 attached to the second pivot member 1400. The first body

1200, the first decoupling insert 1700, the first pivot member 1300, and the first wear pad 1500 comprise the first articulated split friction wedge 1100A of the articulated split friction wedge assembly 1100. The second body 1250, the second decoupling insert 1800, the second pivot member 1400, and the second wear pad 1600 comprise the second articulated split friction wedge 1100B of the articulated split friction wedge assembly 1100. It should be appreciated that in alternative embodiments, the inserts 1700 and 1800 may not be employed.

The friction wedge assembly 1100 is configured to be positioned in a railroad car truck 12 as generally shown in FIGS. 12, 13, 19, and 20 such that: (a) the body 1200 rests on and is supported by one or more of the suspension springs 80; (b) the body 1200 engages the respective downwardly inclined wall 18 of the bolster 14 (or a suitable insert such as insert 1101 there between); (c) the first wear pad 1500 independently engages the respective wear plate 62 attached to the respective column 37 of the respective side frame 28; and (d) the first body 1200 receives the decoupling low coefficient of friction insert 1700 which in turn receives pivot member 1300.

Likewise, the friction wedge assembly 1100 is also configured to be positioned in a railroad car truck 12 such that: (a) the second body 1250 rests on and is supported by one or more of the suspension springs 80; (b) the body 1250 engages the respective downwardly inclined wall 18 of the bolster 14 (or a suitable insert such as insert 1101 there between); (c) the second wear pad 1600 independently engages the respective wear plate 62 attached to the respective column 37 of the respective side frame 28; and (d) the body 1250 receives the decoupling low coefficient of friction insert 1800 which in turn receives the pivot member 1400.

The first body 1200 includes a lateral movement restraint arm 1240 (best shown in FIG. 16) that limits or prevents the outward lateral movement of the first pivot member 1300.

Likewise, the second body 1250 includes a lateral movement restraint arm 1290 (best shown in FIG. 16) that also limits or prevents the outward lateral movement of the second pivot member 1400.

It should be appreciated that: (i) the body 1200 and pivot member 1300 are coupled such that the pivot member 1300 can only translate laterally a small extent relative to body 1200; and (ii) the body 1250 and the pivot member 1400 are coupled such that the pivot member 1400 can only translate laterally a small extent relative to body 1250.

This arrangement or configuration enables the articulated split friction wedge assembly 1100 to perform its various functions and to provide required damping, provide high warp restraint, reduce binding, and enable lateral decoupling. This configuration also enables the articulated split friction wedge assembly 1100 to (along with the other articulated split friction wedge assemblies 1102, 1104, and 1106): (a) reduce wheel wear and damage; (b) reduce rolling resistance; (c) reduce fuel consumption; (d) reduce the need for and thus cost of railroad track repair; (e) reduce truck hunting and improve HSS for both empty and loaded freight railroad cars; (f) reduce truck hunting; and (g) improve curving performance for both empty and loaded freight railroad cars.

It should be appreciated that the combinations of components or features of the articulated split friction wedge assembly 1100 of the present disclosure provide or co-act to provide a combination of various advantages not previously provided by known friction wedges. The individual wedges 1100A and 1100B can be moved or positioned toward each other for ease of installation; (2) the individual wedges 1100A and 1100B will move or be positioned away from each other in operation; (3) the co-acting lateral or transverse angle of the inclined surfaces of the bodies and the insert urge the wedges 1100A and 1100B outwardly to eliminate or reduce the gaps between the wedges 1100A and 1100B and the respective side walls that define the bolster pocket, and thus also resist or limit rotation of the wedges 1100A and 1100B about their central horizontal axes; (4) the bodies 1200 and 1250 will remain mostly against the wall(s) that define the bolster pocket (including the bolster pocket side walls); (5) if the side frames laterally displace, the pivot members 1300 and 1400 will laterally translate relative to bodies 1200 and 1250—but for a limited distance due to the lateral movement restraint arms 1240 and 1290, laterally decouple the side frames 28 and 48 from the bolster 14 to assist in maintaining truck squaring and stiffness; and (6) the individual wedges 1100A and 1100B can independently move or be positioned upwardly and downwardly in operation under warp forces to provide or produce more resistance so that the split wedges 1100A and 1100B will produce higher warp stiffness to provide a higher truck hunting threshold, will lower wheel wear from curving, and does not reduce damping.

It should also be appreciated that the articulation of bodies 1200 and 1250 reduces or decreases the tendency for the friction wedge assembly 1100 to bind with the planar wear plate 62 connected to the interior surface of the column 37 of the side frame 28. This reduction in binding occurs because the bodies 1200 and 1250 respectively pivot relative to the pivot members 1300 and 1400 thereby transferring only or mainly horizontal and/or vertical loads to and/or through the pivot members 1300 and 1400 (or wear pads 1500 and 1600 attached thereto), and thus the wear pads 1500 and 1600 will remain substantially flush with and in contact with the wear plate 62. In other words, high concentrated forces from uneven, or low, friction shoe contact area into the side frame column will be eliminated or significantly reduced, thus improving vertical motion between such components (i.e., substantially reduces the overturning moment imparted (between or to) the vertical wear surfaces).

It should further be appreciated that the composite material feature of the wear pads 1500 and 1600 on the vertical face of the articulated split friction wedge assembly 1100 reduces or decreases the tendency for the friction wedge assembly 1100 to bind with the planar wear plate 62 connected to the interior surface of column 37. In other words, the composite material reduces the coefficient of friction between the side frame and the bolster, and thus reduces binding between such components.

It should further be appreciated that the split feature of the bodies 1100 and 1150 and the split feature of the pivot members 1300 and 1400 and the wear pads 1500 and 1600 of the articulated split friction wedge assembly 1100 reduces or decreases the tendency for the friction wedge assembly 1100 to bind with the planar wear plate 62 that is connected to the interior surface of column 37.

It should further be appreciated that relatively wide pivot members 1300 and 1400 and the wear pads 1500 and 1600 of the articulated split friction wedge 1100 reduce or decrease the tendency for the friction wedge 1100 to bind with the planar wear plate 62 that is connected to the interior surface of column 37.

It should further be appreciated that the independent articulating feature of the bodies 1200 and 1250, the pivot members 1300 and 1400, and the wear pads 1500 and 1600 of the articulated split friction wedge assembly 1100 also evenly distribute loading between the friction wedge and side frame column to reduce a slip-stick behavior.

It should further be appreciated that the independently moveable feature of the bodies 1200 and 1250, the independent articulating feature of pivot members 1300 and 1400, and the wear pads 1500 and 1600 of the articulated split friction wedge assembly 1100 distribute a more relatively even pressure on or across the composite material of the wear pads 1500 and 1600 and the planar wear plate 62 that is connected to the interior surface of column 37, thereby reducing the possibility of high concentrated loads that may break/crush or prematurely wearing the composite material of the wear pads 1500 and 1600.

It should further be appreciated that the relatively wide pivot members 1300 and 1400 and the wear pads 1500 and 1600 of the articulated split friction wedge 1100 increase truck warp stiffness.

It should be further appreciated that pivot member 1300 and 1400 have constrained lateral movement relative to bodies 1200 and 1250 and limited by the lateral movement restraint arms 1240 and 1290, providing lateral displacement capabilities that decouple the side frame lateral motion relative to the bolster 14. In other words, decoupling the side frames and bolster reduces or limits lateral accelerations into the car body, said accelerations originating from wheelset displacements (oscillations), and thus increasing high speed truck stability.

Referring now to FIGS. 21 to 29, another example embodiment of the articulated split friction wedge assemblies of the present disclosure are generally indicated by numerals 2100, 2102, 2104, and 2106 (as best shown in FIGS. 22 and 23) and shown with respect to a truck 12 of a freight railroad car 10 configured to roll along railroad tracks or rails 11.

As with the above described embodiments of the present disclosure, the railroad car of the present disclosure may include one or more trucks with the articulated split friction wedge assemblies of this example embodiment of the present disclosure. As with the above described embodiment of the present disclosure shown in FIGS. 2 to 10, each truck of the present disclosure may include one or more articulated split friction wedge assemblies of this example embodiment of the present disclosure. In various embodiments, a truck will include four articulated split friction wedge assemblies as generally shown in FIGS. 21 and 22. Each of the example articulated split friction wedge assemblies of the present disclosure that are generally indicated by numerals 2100, 2102, 2104, and 2106 includes two articulated split friction wedges generally and respectively indicated by numerals 2100A and 2100B, 2102A and 2102B, 2104A and 2104B, and 2106A and 2106B.

As with the above described embodiment of the present disclosure, in this example illustrated embodiment, the truck 12 generally includes a bolster 14 and two spaced apart generally parallel side frames 28 and 48. The side frame 28 generally includes a body 30 having two spaced downwardly extending pedestal jaws including a first pedestal jaw 32 and a second pedestal jaw 36 on the opposite sides of the central opening 34 of the side frame 28. The first pedestal jaw 32 and the second pedestal jaw 36 of the first side frame 28 respectively include a pair of spaced apart generally vertically extending columns 33 and 37. The truck 12 includes: (a) a generally planar wear plate 60 connected to the interior surface of column 33; and (b) a generally planar wear plate 62 connected to the interior surface of column 37.

As with the above described embodiments of the present disclosure, in this example illustrated embodiment, side frame 48 generally includes a body 50 having two downwardly extending pedestal jaws including a first pedestal jaw 52 and a second pedestal jaw 56 on the opposite sides of the central opening 54 of the side frame 48. The first pedestal jaw 52 and the second pedestal jaw 56 of the second side frame 48 respectively include a pair of spaced apart generally vertically extending columns 53 and 57. The truck 12 includes: (a) a generally planar wear plate 70 connected to the interior surface of column 53; and (b) a generally planar wear plate 72 connected to the interior surface of column 57.

As with the above described embodiments of the present disclosure, in this example illustrated embodiment, the bolster 14 generally includes two opposite ends 16 and 22 that are respectively positioned in central opening 34 defined by side frame 28 and central opening 54 defined by side frame 48. End 16 of the bolster 14 is vertically supported by a plurality of helical coil suspension springs or spring groups 80. The suspension springs 80 are resiliently compressible to thereby enable the end 16 of the bolster 14 to move vertically upwardly and downwardly within the opening 34 and with respect to the side frame 28. Likewise, end 22 of the bolster 14 is vertically supported by a plurality of helical coil suspension springs or spring groups 92. The suspension springs 92 are resiliently compressible to thereby enable the end 22 of the bolster 14 to move vertically upwardly and downwardly within the opening 54 and with respect to the side frame 48.

As with the above described embodiments of the present disclosure, in this example illustrated embodiment, the end 16 of the bolster 14 includes a rearwardly facing inclined wall 18 configured to receive or accept an insert such as insert 2101 that has a plurality of rearwardly facing inclined walls configured to engage or be engaged by the friction wedge assembly 2100 of the present disclosure and particularly by the friction wedges 2100A and 2100B of the friction wedge assembly 2100. Likewise, in this example illustrated embodiment, the end 16 of the bolster 14 also includes a forwardly facing inclined wall 20 configured to receive or accept an insert such as insert 2103 that has a plurality of forwardly facing inclined walls configured to engage or be engaged by a friction wedge assembly 2102 of the present disclosure and particularly by the friction wedges 2102A and 2102B of the friction wedge assembly 2102. Likewise, in this example illustrated embodiment, the end 22 of the bolster 14 includes forwardly and rearwardly facing inclined sets of walls collectively labeled 24 and collectively labeled 26 that are each configured to receive or accept a respective insert such as inserts 2105 and 2107 that each have a plurality of forwardly and rearwardly facing inclined walls configured to engage or be engaged by a respective friction wedge assembly of the present disclosure such as friction wedge assemblies 2104 and 2106.

In various other embodiments, bolster pocket inserts such as bolster pockets inserts 2101, 2103, 2105, and 2107 are employed in other configurations.

As with the above described embodiments of the present disclosure, although not shown, the truck 12 of this example embodiment includes other conventional components as will be readily appreciated by one of ordinary skill in the art.

As with the above described embodiments of the present disclosure, it should also be appreciated that articulated split friction wedge assembly of this example embodiment of the present disclosure are shown used in four separate places for the truck 12 in this illustrated embodiment, and indicated by numerals 2100, 2102, 2104, and 2106 For brevity, only articulated split friction wedge assembly 2100 will be discussed in detail. In this illustrated example embodiment, the articulated split friction wedge assemblies 2100, 2102, 2104, and 2106 are identical.

As best shown in FIGS. 23 to 29, the illustrated example articulated split friction wedge assembly 2100 generally includes: (a) a first body 2200; (b) a second body 2250; (c) a first decoupling low coefficient of friction insert 2700; (d) a second decoupling low coefficient of friction insert 2800; (e) a first pivot member 2300 pivotally moveable with respect to the first body 2200 and the first decoupling insert 2700; (f) a second pivot member 2400 pivotally moveable with respect to the second body 2250 and the second decoupling insert 2800; (g) a first wear pad 2500 attached to the first pivot member 2300; and (h) a second wear pad 2600 attached to the second pivot member 2400. The first body 2200, the first decoupling insert 2700, the first pivot member 2300, and the first wear pad 2500 comprise the first articulated split friction wedge 2100A of the articulated split friction wedge assembly 2100. The second body 2250, the second decoupling insert 2800, the second pivot member 2400, and the second wear pad 2600 comprise the second articulated split friction wedge 2100B of the articulated split friction wedge assembly 2100. It should be appreciated that in alternative embodiments, the inserts 2700 and 2800 may not be employed.

The friction wedge assembly 2100 is configured to be positioned in a railroad car truck 12 as generally shown in FIGS. 21, 22, 28, and 29 such that: (a) the body 2200 rests on and is supported by one or more of the suspension springs 80; (b) the body 2200 engages the respective downwardly inclined wall 18 of the bolster 14 (or a suitable insert such as insert 2101 there between); (c) the first wear pad 2500 independently engages the respective wear plate 62 attached to the respective column 37 of the respective side frame 28; and (d) the first body 2200 receives the decoupling low coefficient of friction insert 2700 which in turn receives pivot member 2300. Likewise, the friction wedge assembly 2100 is also configured to be positioned in a railroad car truck 12 such that: (a) the second body 2250 rests on and is supported by one or more of the suspension springs 80; (b) the body 2250 engages the respective downwardly inclined wall 18 of the bolster 14 (or a suitable insert such as insert 2101 there between); (c) the second wear pad 2600 independently engages the respective wear plate 62 attached to the respective column 37 of the respective side frame 28; and (d) the body 2250 receives the decoupling low coefficient of friction insert 2800 which in turn receives the pivot member 2400.

The first pivot member 2300 includes a lateral movement restraint arm 2340 (best shown in FIGS. 24, 26, and 27) that: (1) limits or prevents the outward lateral movement of the first body 2200; and (2) limits or prevents the inward lateral movement of the first pivot member 2300.

Likewise, the second pivot member 2400 includes a lateral movement restraint arm 2440 (best shown in FIGS. 23, 24, and 25) that: (1) limits or prevents the outward lateral movement of the second body 2250; and (2) limits or prevents the inward lateral movement of the second pivot member 2400.

It should be appreciated that: (i) the body 2200 and pivot member 2300 are coupled such that the pivot member 2300 can only translate laterally a small extent relative to body 2200; and (ii) body 2250 and the pivot member 2400 are coupled such that the pivot member 2400 can only translate laterally a small extent relative to body 2250.

This arrangement or configuration enables the articulated split friction wedge assembly 2100 to perform its various functions and to provide required damping, provide high warp restraint, reduce binding, and enable lateral decoupling. This configuration also enables the articulated split friction wedge assembly 2100 to (along with the other articulated split friction wedge assemblies 2102, 2104, and 2106): (a) reduce wheel wear and damage; (b) reduce rolling resistance; (c) reduce fuel consumption; (d) reduce the need for and thus cost of railroad track repair; € reduce truck hunting and improve HSS for both empty and loaded freight railroad cars; (f) reduce truck hunting; and (g) improve curving performance for both empty and loaded freight railroad cars.

It should be appreciated that the combinations of components or features of the articulated split friction wedge assembly 2100 of the present disclosure provide or co-act to provide a combination of various advantages not previously provided by known friction wedges. The individual wedges 2100A and 2100B can be moved or positioned toward each other for ease of installation; (2) the individual wedges 2100A and 2100B will move or be positioned away from each other in operation; (3) the co-acting lateral or transverse angle of the inclined surfaces of the bodies and the insert urge the wedges 2100A and 2100B outwardly to eliminate or reduces the gaps between the wedges 2100A and 2100B and the respective side walls that define the bolster pocket, and thus also resist or limit rotation of the wedges 2100A and 2100B about their central horizontal axes; (4) the bodies 2200 and 2250 will remain mostly against the wall(s) that define the bolster pocket (including the bolster pocket side walls); (5) if the side frames laterally displace, the pivot members 2300 and 2400 will laterally translate relative to bodies 2200 and 2250—but for a limited distance due to the lateral movement restraint arms 2340 and 2440, laterally decouple the side frames 28 and 48 from the bolster 14 to assist in maintaining truck squaring and stiffness; and (6) the individual wedges 2100A and 2100B can independently move or be positioned upwardly and downwardly in operation under warp forces to provide or produce more resistance so that the split wedges 2100A and 2100B will produce higher warp stiffness to provide a higher truck hunting threshold, will lower wheel wear from curving, and does not reduce damping.

It should also be appreciated that the articulation of bodies 2200 and 2250 reduces or decreases the tendency for the friction wedge assembly 2100 to bind with the planar wear plate 62 connected to the interior surface of the column 37 of the side frame 28. This reduction in binding occurs because the bodies 2200 and 2250 respectively pivot relative to the pivot members 2300 and 2400 thereby transferring only or mainly horizontal and/or vertical loads to and/or through the pivot members 2300 and 2400 (or wear pads 2500 and 2600 attached thereto), and thus the wear pads 2500 and 2600 will remain substantially flush with and in contact with the wear plate 62. In other words, high concentrated forces from uneven, or low, friction shoe contact area into the side frame column will be eliminated or significantly reduced, thus improving vertical motion between such components (i.e., substantially reduces the overturning moment imparted (between or to) the vertical wear surfaces.)

It should further be appreciated that the composite material feature of the wear pads 2500 and 2600 on the vertical face of the articulated split friction wedge assembly 2100 reduces or decreases the tendency for the friction wedge assembly 2100 to bind with the planar wear plate 62 connected to the interior surface of column 37. In other words, the composite material reduces the coefficient of friction between the side frame and the bolster, and thus reduces binding between such components.

It should further be appreciated that the split feature of the bodies 2100 and 2150 and the split feature of the pivot members 2300 and 2400 and the wear pads 2500 and 2600 of the articulated split friction wedge assembly 2100 reduces or decreases the tendency for the friction wedge assembly 2100 to bind with the planar wear plate 62 that is connected to the interior surface of column 37.

It should further be appreciated that relatively wide pivot members 2300 and 2400 and the wear pads 2500 and 2600 of the articulated split friction wedge 2100 reduce or decrease the tendency for the friction wedge 2100 to bind with the planar wear plate 62 that is connected to the interior surface of column 37.

It should further be appreciated that the independent articulating feature of the bodies 2200 and 2250, the pivot members 2300 and 2400, and the wear pads 2500 and 2600 of the articulated split friction wedge assembly 2100 also evenly distribute loading between the friction wedge and side frame column to reduce a slip-stick behavior.

It should further be appreciated that the independently moveable feature of the bodies 2200 and 2250, the independent articulating feature of pivot members 2300 and 2400, and the wear pads 2500 and 2600 of the articulated split friction wedge assembly 2100 distribute a more relatively even pressure on or across the composite material of the wear pads 2500 and 2600 and the planar wear plate 62 that is connected to the interior surface of column 37, thereby reducing the possibility of high concentrated loads that may break/crush or prematurely wearing the composite material of the wear pads 2500 and 2600.

It should further be appreciated that the relatively wide pivot members 2300 and 2400 and the wear pads 2500 and 2600 of the articulated split friction wedge 2100 increase truck warp stiffness.

It should be further appreciated that pivot member 2300 and 2400 have constrained lateral movement relative to bodies 2200 and 2250, providing lateral displacement capabilities that decouple the side frame lateral motion relative to the bolster 14. In other words, decoupling the side frames and bolster reduces or limits lateral accelerations into the car body, said accelerations originating from wheelset displacements (oscillations), and thus increasing high speed truck stability.

It should be appreciated that in certain embodiments, the articulated wedge includes a first body with a receiving groove and a second body with a cylindrical pivoting surface the extends into the receiving groove to enable rocking movements between the two bodies. The groove terminates in a wall that limits the axial travel of the cylindrical surface, while allowing a certain amount of that travel. A decoupling insert may be included to line the pivoting groove and provide desired frictional properties therein. Wear pads are also optionally included in various combinations to provide desirable frictional relationship between the vertical face of the second body and the column wear plate of the side frame.

It should thus be appreciated that various embodiments of the articulated split friction wedge of the present disclosure assist in meeting the demands in the railroad industry for improved freight car truck performance to: (a) reduce wheel wear and damage; (b) reduce rolling resistance; (c) reduce fuel consumption; (d) reduce the need for and thus cost of railroad track repair; (e) reduce truck hunting and improve HSS for both empty and loaded freight railroad cars; and (f) improve curving performance for both empty and loaded freight railroad cars.

It will be understood that modifications and variations may be effected without departing from the scope of the novel concepts of the present invention, and it is understood that this application is to be limited only by the scope of the claims.

We claim:

1. A railroad car articulated split friction wedge assembly comprising:

a first articulated split friction wedge including:

(a) a first body including an inclined surface, a socket on a second surface, and a first lateral movement restraint arm positioned at an end of the socket, the second surface on an opposing side of the first body from the inclined surface, and (b) a first pivot member comprising a pivot positioned within the socket of the first body, and the first pivot member pivotally moveable with respect to the first body; and a second articulated split friction wedge including:

(a) a second body including an inclined surface, a socket on a second surface, and a second lateral movement restraint arm positioned at an end of the socket, the second surface on an opposing side of the second body from the inclined surface, and (b) a second pivot member comprising a pivot positioned within the socket of the second body, and the first pivot member pivotally moveable with respect to the second body, and independently of the first pivot member.

2. The railroad car articulated split friction wedge of claim 1, wherein the first body is generally triangular and includes: (i) a base; (ii) the inclined surface extending upwardly at an acute angle from the base; and (iii) a pivot receiver surface extending from the base.

3. The railroad car articulated split friction wedge of claim 2, wherein the acute angle is approximately 30 to 45 degrees.

4. The railroad car articulated split friction wedge of claim 2, wherein the acute angle is approximately 32 degrees.

5. The railroad car articulated split friction wedge of claim 1, wherein the socket of the first body includes an inwardly facing concave semi-cylindrical surface.

6. The railroad car articulated split friction wedge of claim 5, wherein the first pivot member includes an upstanding wall and the pivot integrally connected to and extending from the upstanding wall, said pivot pivotally received in a first decoupling insert which is received within the first socket.

7. The railroad car articulated split friction wedge of claim 1, wherein the first pivot member and the second pivot member have a combined width of approximately 6.50 inches.

8. The railroad car articulated split friction wedge of claim 1, wherein the first pivot member includes a generally rectangular first portion and a smaller generally rectangular second portion extending from a side of the first portion.

9. The railroad car articulated split friction wedge of claim 1, wherein a first decoupling insert is positioned within the socket of the first body and the pivot of the first pivot member is positioned within the first decoupling insert, and wherein a second decoupling insert is positioned within the socket of the second body and the pivot of the second pivot member is positioned within the second decoupling insert.

10. The railroad car articulated split friction wedge of claim 9, wherein the first and second decoupling inserts are made from a material with a low coefficient of friction.

11. The railroad car articulated split friction wedge of claim 1, wherein the first and second bodies are laterally moveable relative to each other.

12. The railroad car articulated split friction wedge assembly of claim 1, wherein the inclined surface of the first body and the inclined surface of the second body are positioned against an inclined surface bolster or an inclined bolster insert.

13. A railroad car articulated split friction wedge assembly comprising:

a first articulated split friction wedge including:

(a) a first body comprising an inclined surface, a socket on a second surface, the second surface on an opposing side of the first body from the inclined surface, and (b) a first pivot member comprising a pivot positioned within the socket of the first body and a first lateral movement restraint arm extending outward from the first pivot member and alongside a face of the first body, the first pivot member pivotally moveable with respect to the first body; and a second articulated split friction wedge including:

(a) a second body comprising an inclined surface, a socket on a second surface, the second surface on an opposing side of the second body from the inclined surface, and (b) a second pivot member comprising a pivot positioned within the socket of the second body and a second lateral movement restraint arm extending outward from the second pivot member and alongside a face of the second body, and the second pivot member pivotally moveable with respect to the second body, and independently of the first pivot member.

14. The railroad car articulated split friction wedge of claim 13, wherein the first body is generally triangular and includes: (i) a base; (ii) the inclined surface extending upwardly at an acute angle from the base; and (iii) a pivot receiver extending from the base.

15. The railroad car articulated split friction wedge of claim 14, wherein the acute angle is approximately 30 to 45 degrees.

16. The railroad car articulated split friction wedge of claim 14, wherein the acute angle is approximately 32 degrees.

17. The railroad car articulated split friction wedge of claim 13, wherein the socket of the first body includes an inwardly facing concave semi-cylindrical surface.

18. The railroad car articulated split friction wedge of claim 17, wherein the first pivot member includes an upstanding wall and the pivot integrally connected to and extending from the upstanding wall, said pivot pivotally received in a first decoupling insert which is received within the socket of the first body.

19. The railroad car articulated split friction wedge of claim 13, wherein the first pivot member and the second pivot member have a combined width of approximately 6.50 inches.

20. The railroad car articulated split friction wedge of claim 13, wherein a first decoupling insert is positioned within the socket of the first body and the pivot of the first pivot member is positioned within the first decoupling insert, and wherein a second decoupling insert is positioned within the socket of the second body and the pivot of the second pivot member is positioned within the second decoupling insert.

21. The railroad car articulated split friction wedge of claim 20, wherein the first and second decoupling inserts are made from a material with a low coefficient of friction.

22. The railroad car articulated split friction wedge of claim 13, wherein the first and second bodies are laterally moveable relative to each other.

23. The railroad car articulated split friction wedge assembly of claim 13, wherein at least one of the inclined surface of the first body and the inclined surface of the second body are positioned against an inclined surface bolster or an inclined bolster insert.

24. A railroad car articulated split friction wedge assembly comprising:

a first articulated split friction wedge including:

a first body comprising:

an inclined surface positioned against an inclined wall of a bolster or an insert connected to the bolster, and a socket on a second surface, the second surface on an opposing side of the first body from the inclined surface;

a first decoupling insert positioned within the socket;

a first pivot member comprising a pivot positioned with the first decoupling insert, and the first pivot member pivotally moveable within the socket of the first body and the first decoupling inserts;

a lateral movement restraint positioned at one end of the socket of the first body to contact the first body or first pivot member to limit lateral movement; and a first composite wear pad attached to a second surface of the first pivot member, the second surface on an opposing side of the first pivot member from the pivot; and a second articulated split friction wedge including:

a second body comprising:

an inclined surface positioned against the inclined wall of the bolster or the insert connected to the bolster, and a socket on a second surface, the second surface on an opposing side of the second body from the inclined surface;

a second decoupling insert positioned within the socket;

a second pivot member pivotally comprising a pivot positioned with the second decoupling insert, and the second pivot member pivotally moveable within the socket of the second body and the second decoupling insert, and independently of the first pivot member and the first decoupling insert;

a lateral movement restraint positioned at one end of the socket of the first body to contact the first body or first pivot member to limit lateral movement; and a second composite wear pad attached to a second surface of the second pivot member, the second surface on an opposing side of the second pivot member from the pivot.

25. The railroad car articulated split friction wedge of claim 24, wherein the first body is generally triangular and includes: (i) a base; (ii) the inclined surface extending upwardly at an acute angle from the base; and (iii) a pivot receiver extending from the base.

26. The railroad car articulated split friction wedge of claim 24, wherein the first socket of the first body includes an inwardly facing concave semi-cylindrical surface.

27. The railroad car articulated split friction wedge of claim 26, wherein the first pivot member includes an upstanding wall and the pivot integrally connected to and extending from the upstanding wall, said pivot pin pivotally received in the first decoupling insert which is received within the first socket.

28. The railroad car articulated split friction wedge of claim 24, wherein the first pivot member, the second pivot member, the first composite wear pad, and the second composite wear have a combined width of approximately 6.50 inches.

29. The railroad car articulated split friction wedge of claim 24, wherein the first pivot member includes a generally rectangular first portion and a smaller generally rectangular second portion extending from a side of the first portion.

30. The railroad car articulated split friction wedge of claim 29, wherein the first wear pad includes a generally rectangular first portion and a smaller generally rectangular second portion extending from a side of the first portion.

31. The railroad car articulated split friction wedge of claim 24, wherein the first and second decoupling inserts are made from a material with a low coefficient of friction.

32. The railroad car articulated split friction wedge of claim 24, wherein the first and second decoupling inserts are made from a material with a lower coefficient of friction than the material of the first and second composite wear pads.

33. The railroad car articulated split friction wedge of claim 24, wherein the first and second bodies are laterally moveable relative to each other.

34. The railroad car articulated split friction wedge of claim 24, wherein the first articulated split friction wedge and the second articulated split friction wedge both contact the bolster or the insert connected to the bolster, and the first articulated split friction wedge and the second articulated split friction wedge are independently moveable relative to the bolster or the insert connected to the bolster.

* * * * *